US009573384B2

(12) United States Patent
Yoneta

(10) Patent No.: US 9,573,384 B2
(45) Date of Patent: Feb. 21, 2017

(54) THERMAL HEAD AND THERMAL PRINTER

(71) Applicant: KYOCERA Corporation, Kyoto-shi, Kyoto (JP)

(72) Inventor: Masashi Yoneta, Kyoto (JP)

(73) Assignee: KYOCERA CORPORATION, Kyoto-Shi, Kyoto (JP)

( * ) Notice: Subject to any disclaimer, the term of this patent is extended or adjusted under 35 U.S.C. 154(b) by 0 days.

(21) Appl. No.: 15/112,877

(22) PCT Filed: Jan. 28, 2015

(86) PCT No.: PCT/JP2015/052366
§ 371 (c)(1),
(2) Date: Jul. 20, 2016

(87) PCT Pub. No.: WO2015/115485
PCT Pub. Date: Aug. 6, 2015

(65) Prior Publication Data

US 2016/0339716 A1 Nov. 24, 2016

(30) Foreign Application Priority Data

Jan. 28, 2014 (JP) ..... 2014-013454

(51) Int. Cl.
*B41J 2/15* (2006.01)
*B41J 2/335* (2006.01)

(52) U.S. Cl.
CPC ..... *B41J 2/3352* (2013.01)

(58) Field of Classification Search
CPC ..... B41J 2/14072; B41J 2/04541; B41J 2002/14491; B41J 2/1753; B41J 2/1404; B41J 2202/13; B41J 2202/18; B41J 2/01
See application file for complete search history.

(56) References Cited

U.S. PATENT DOCUMENTS 5,450,101 A 9/1995 Ishida et al.
7,088,379 B2 * 8/2006 Chida ..... H04N 1/00912 347/214

(Continued)

FOREIGN PATENT DOCUMENTS

JP 05-177856 A 7/1993
JP 07-032634 A 2/1995

(Continued)

OTHER PUBLICATIONS

International Search Report, PCT/JP2015/052366, Mar. 31, 2015, 2 pgs.

*Primary Examiner* — Lamson Nguyen
(74) *Attorney, Agent, or Firm* — Volpe and Koenig, P.C.

(57) ABSTRACT

A thermal head includes: a substrate; a heat generating portion disposed on the substrate; a first electrode electrically connected to the heat generating portion; a driving IC which controls actuation of the heat generating portion; a first cover member which covers the driving IC; a connection member which is disposed on the substrate and has a connecting section electrically connected to a second electrode; and a second cover member which covers the connecting section and extends toward the first cover member. The second cover member includes a first portion and a second portion which is thinner than the first portion. The first portion is disposed next to the connection member. The second portion lies farther away from the connection member than the first portion, and includes an overlying part which overlies the first cover member.

20 Claims, 19 Drawing Sheets

(56) References Cited

U.S. PATENT DOCUMENTS

| | | | | |
|---|---|---|---|---|
| 7,811,014 | B2 * | 10/2010 | Tamaki | B41J 25/3088 347/8 |
| 8,373,735 | B2 * | 2/2013 | Arai | G03G 15/326 347/237 |

FOREIGN PATENT DOCUMENTS

| | | | |
|---|---|---|---|
| JP | 07-148961 | A | 6/1995 |
| JP | 09-039281 | A | 2/1997 |
| JP | 11-020216 | A | 1/1999 |
| JP | 2001-113741 | A | 4/2001 |
| JP | 2004-058541 | A | 2/2004 |

* cited by examiner

THERMAL HEAD AND THERMAL PRINTER

TECHNICAL FIELD

The present invention relates to a thermal head and a thermal printer.

BACKGROUND ART

As printing devices for use in facsimiles, video printers, and so forth, various types of thermal heads have been proposed to date. For example, there is known a thermal head including: a substrate; a heat generating portion disposed on the substrate; an electrode which is disposed on the substrate and is electrically connected to the heat generating portion; a driving IC which is disposed on the substrate and controls actuation of the heat generating portion; a first cover member which covers the driving IC; a connection member which is disposed on the substrate and has a connecting section for providing electrical connection between the electrode and the exterior thereof; and a second cover member which covers the connection member (refer to Patent Literature 1, for example).

There is also known a thermal head including an external substrate which is disposed next to a substrate, has a wiring conductor connected to an electrode, and a driving IC and a connection member which are disposed on the external substrate (refer to Patent Literature 2, for example).

CITATION LIST

Patent Literature

Patent Literature 1: Japanese Unexamined Patent Publication JP-A 2001-113741

Patent Literature 2: Japanese Unexamined Patent Publication JP-A 05-177856 (1993)

SUMMARY OF INVENTION

Technical Problem

In the above-described thermal heads, however, there is the possibility of separation of the connection member from the substrate or the external substrate.

Solution to Problem

A thermal head according to one embodiment of the invention includes: a substrate; a heat generating portion disposed on the substrate; a first electrode which is disposed on the substrate and is electrically connected to the heat generating portion; a driving IC which is disposed on the substrate and controls actuation of the heat generating portion; a first cover member which covers the driving IC; a connection member which is disposed on the substrate and has a second electrode extending from the driving IC and a connecting section electrically connected to the second electrode; and a second cover member which covers the connecting section and extends toward the first cover member. The second cover member includes a first portion and a second portion which is thinner than the first portion. Moreover, the first portion is disposed next to the connection member. Moreover, the second portion lies farther away from the connection member than the first portion, and includes an overlying part which overlies the first cover member.

A thermal head according to one embodiment of the invention includes: a substrate; a heat generating portion disposed on the substrate; an electrode which is disposed on the substrate and is electrically connected to the heat generating portion; an external substrate which is disposed next to the substrate and comprises a wiring conductor connected to the electrode; a driving IC which is disposed on the external substrate and controls actuation of the heat generating portion; a first cover member which covers the driving IC; a connection member having a connecting section electrically connected to the wiring conductor; and a second cover member which covers the connecting section and extends toward the first cover member. The second cover member includes a first portion and a second portion which is thinner than the first portion. Moreover, the first portion is disposed next to the connection member. Moreover, the second portion lies farther away from the connection member than the first portion, and includes an overlying part which overlies the first cover member.

A thermal head according to one embodiment of the invention includes: a substrate; a heat generating portion disposed on the substrate; an electrode which is disposed on the substrate and is electrically connected to the heat generating portion; an external substrate which is disposed next to the substrate and comprises a wiring conductor connected to the electrode; a driving IC which is disposed on the substrate and controls actuation of the heat generating portion; a first cover member which covers the driving IC; a connection member having a connecting section electrically connected to the wiring conductor; and a second cover member which covers the connecting section and extends toward the first cover member. The second cover member includes a first portion and a second portion which is thinner than the first portion. Moreover, the first portion is disposed next to the connection member. Moreover, the second portion lies farther away from the connection member than the first portion, and includes an overlying part which overlies the first cover member.

A thermal printer according to one embodiment of the invention includes: the above-described thermal head; a conveyance mechanism which conveys a recording medium onto the heat generating portion; and a platen roller which presses the recording medium from above against the heat generating portion.

Advantageous Effects of Invention

It is possible to reduce the possibility of separation of a connection member from a substrate or an external substrate.

DESCRIPTION OF EMBODIMENTS

First Embodiment

Figure 1:
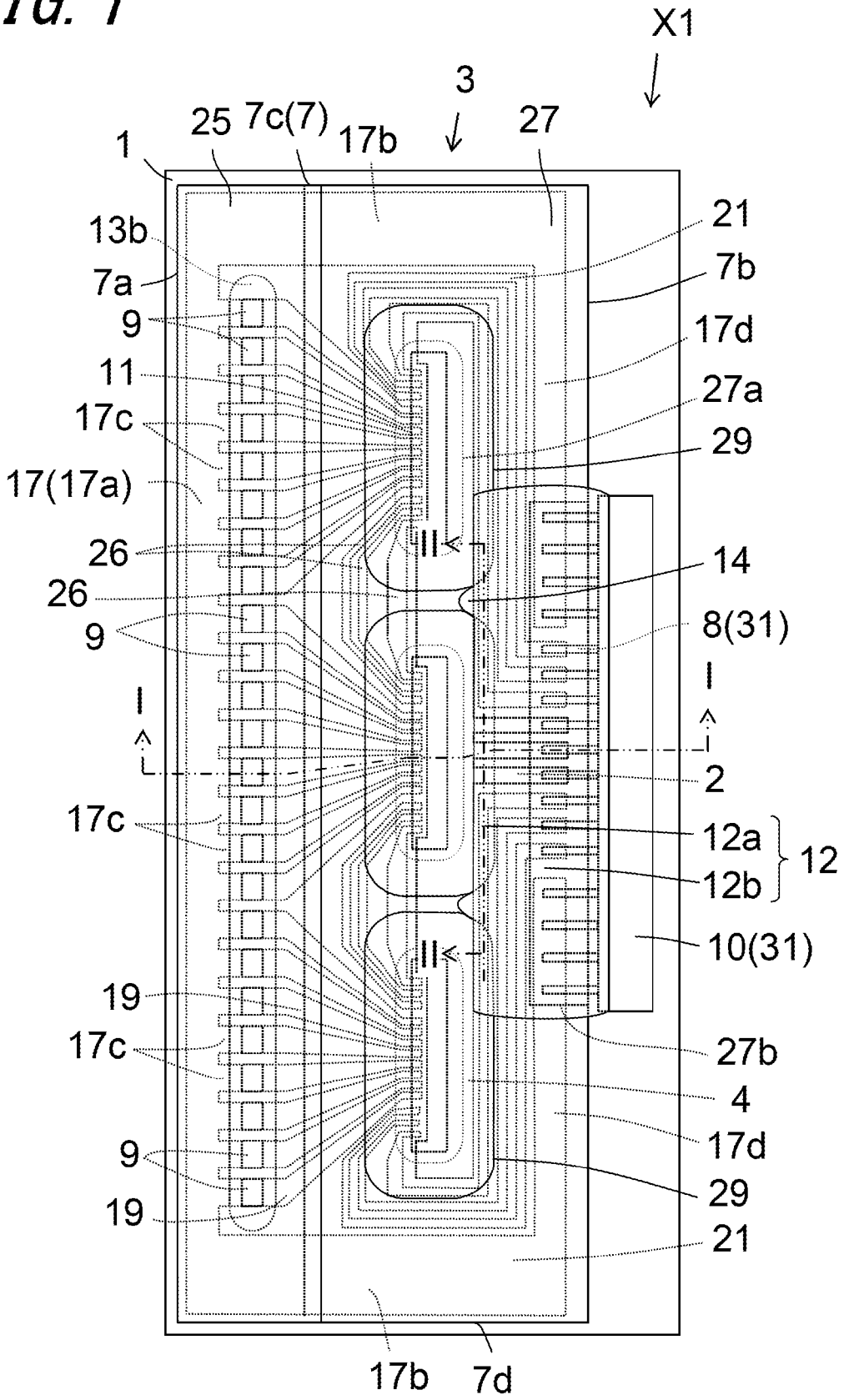
FIG. 1 is a plan view of a thermal head in accordance with a first embodiment of the invention.

Hereinafter, a thermal head X1 will be described with reference to FIGS. 1 to 3. The thermal head X1 comprises: a heat dissipating plate 1; a head base body 3 placed on the heat dissipating plate 1; and a connector 31 connected to the head base body 3. The connector 31 is secured to the head base body 3 via a second cover member 12. The first embodiment will be described with respect to the case where the connector 31 having a connector pin 8 serves as a connection member for providing electrical connection between the construction and the exterior thereof.

The heat dissipating plate 1 is made of a metal material such for example as copper, iron, or aluminum, and has the function of dissipating, out of the heat generated by a heat generating portion 9 of the head base body 3, heat which is not conducive to printing. The heat dissipating plate 1 is quadrangular-shaped as seen in a plan view, and, the head base body 3 is bonded to the upper surface of the heat dissipating plate 1 by means of double-faced tape, an adhesive, or otherwise (not shown in the drawing).

The head base body 3 is rectangular-shaped as seen in a plan view, and, each constituent member of the thermal head X1 is disposed on a substrate 7 of the head base body 3. The head base body 3 has the function of performing printing on a recording medium (not shown) in response to an externally supplied electric signal.

The connector 31 comprises a plurality of connector pins 8 and a housing 10 which accommodates the plurality of connector pins 8. One side of each of the plurality of connector pins 8 is exposed from the housing 10, and the other side thereof is accommodated within the housing 10.

The plurality of connector pins 8 have the function of ensuring electrical conduction between each of various electrodes of the head base body 3 and an externally-provided component, for example, a power source, and, the connector pins 8 are electrically independent of each other.

The housing 10 has the function of accommodating the connector pins 10 in an electrically independent state. The housing 10 effects supply of electricity to the head base body 3 through the attachment and detachment of an externally-disposed connector (not shown).

The connector pin 8 is required to have electrical conductivity, and is thus made of a metal or an alloy. The housing 10 is constructed of an insulating member.

The following describes the constituent members of the head base body 3.

The substrate 7 is placed on the heat dissipating plate 1, and is quadrangular-shaped as seen in a plan view. Thus, the substrate 7 is defined by one long side 7*a*, the other long side 7*b*, one short side 7*c*, and the other short side 7*d*. Moreover, a side face 7*e* is located on a side of the other short side 7*b*. For example, the substrate 7 is made of an electrically insulating material such as alumina ceramics, or a semiconductor material such as single-crystal silicon.

A thermal storage layer 13 is formed on the upper surface of the substrate 7. The thermal storage layer 13 comprises an underlayer portion 13*a* and a protuberant portion 13*b*. The underlayer portion 13*a* is formed over the left half of the upper surface of the substrate 7. The protuberant portion 13*b* extends in strip form along a direction in which a plurality of heat generating portions 9 are disposed (hereafter also referred to as "main scanning direction"), and has a substantially semi-elliptical sectional profile. The protuberant portion 13*b* serves to satisfactorily press a recording medium P which is subjected to printing (refer to FIG. 5) against a protective layer 25 formed on the heat generating portion 9.

The thermal storage layer 13 is made of glass having a low thermal conductivity, and temporarily stores part of the heat generated by the heat generating portion 9. This makes it possible to shorten the time required for a temperature rise in the heat generating portion 9, and thereby achieve the capability of improving the thermal response characteristics of the thermal head X1. For example, the thermal storage layer 13 is formed by applying a predetermined glass paste, which is obtained by blending a suitable organic solvent in glass powder, to the upper surface of the substrate 7 by a heretofore known method such as screen printing technique, and firing this paste.

An electrical resistance layer 15 is disposed on the upper surface of the thermal storage layer 13, and, on the electrical resistance layer 15, there are provided a connection terminal 2, a ground electrode 4, a common electrode 17, an individual electrode 19, an IC-connector connection electrode 21, and an IC-IC connection electrode 26. The electrical resistance layer is patterned in the same configuration as the connection terminal 2, the ground electrode 4, the common electrode 17, the individual electrode 19, the IC-connector connection electrode 21, and the IC-IC connection electrode 26. In a region between the common electrode 17 and the individual electrode 19, the electrical resistance layer 15 is partly left exposed, thus providing an exposed electrical resistance layer 15 region. As shown in FIG. 1, exposed regions of the electrical resistance layer 15 are placed on the protuberant portion 13*b* of the thermal storage layer 13 in a row, and, each exposed region constitutes the heat generating portion 9.

The plurality of heat generating portions 9, while being illustrated in simplified form in FIG. 1 for convenience in explanation, are disposed at a density of 100 to 2400 dpi (dot per inch), for example. The electrical resistance layer 15 is made of a material having a relatively high electrical resistance such for example as a TaN-based material, a TaSiO-based material, a TaSiNO-based material, a TiSiO-based material, a TiSiCO-based material, or a NbSiO-based material. Thus, upon application of a voltage to the heat generating portion 9, the heat generating portion 9 is caused to produce heat under Joule heating effect.

Figure 2:
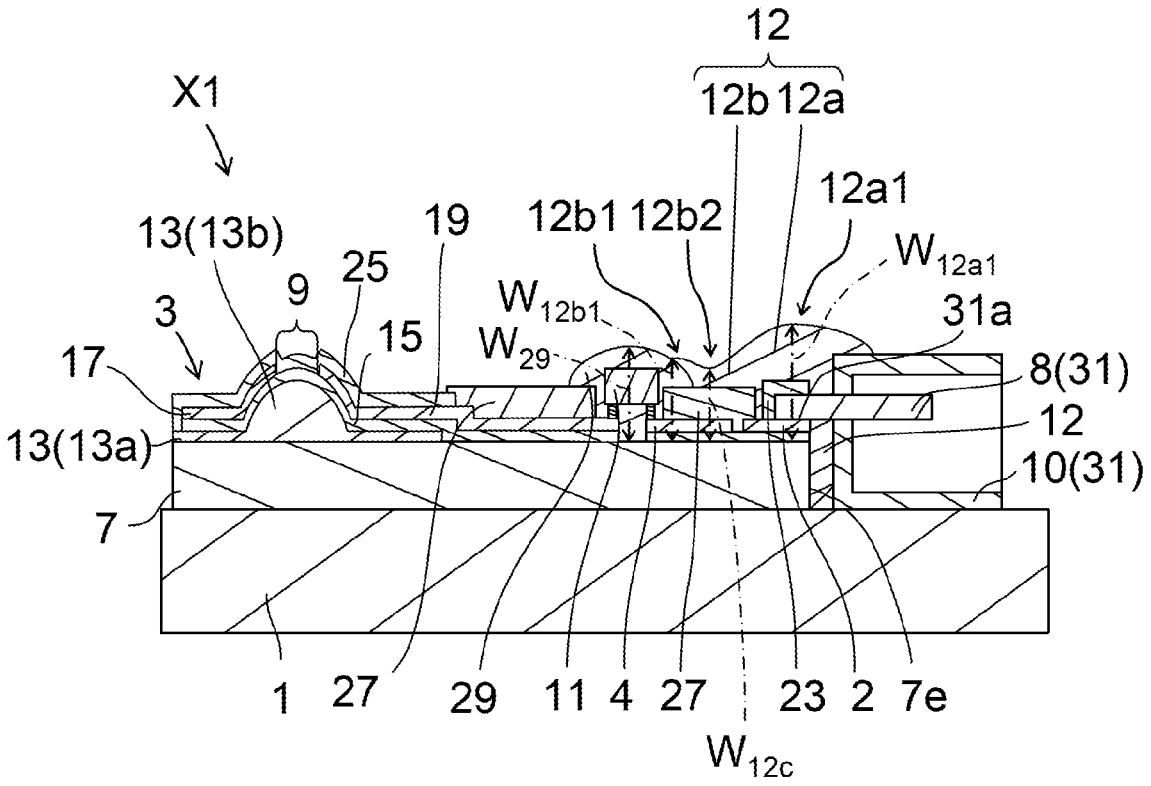
FIG. 2 is a sectional view of the thermal head taken along the line I-I shown in FIG. 1.

As shown in FIGS. 1 and 2, the upper surface of the electrical resistance layer 15 is provided with the connection terminal 2, the ground electrode 4, the common electrode 17, a plurality of individual electrodes 19, the IC-connector connection electrode 21, and the IC-IC connection electrode 26. The connection terminal 2, the ground electrode 4, the common electrode 17, the individual electrodes 19, the IC-connector connection electrode 21, and the IC-IC connection electrode 26 are made of a material having electrical conductivity such for example as one metal material selected from among aluminum, gold, silver, and copper, or an alloy of these metals.

The common electrode 17 comprises main wiring portions 17*a* and 17*d*, a sub wiring portion 17*b*, and a lead portion 17*c*. The main wiring portion 17*a* extends along one long side 7*a* of the substrate 7. Two sub wiring portions 17*b* extend along one short side 7*c* and the other short side 7*d*, respectively, of the substrate 7. A plurality of lead portions 17*c* extend from the main wiring portion 17*a* toward the corresponding heat generating portions 9 on an individual basis. The main wiring portion 17*d* extends along the other long side 7*b* of the substrate 7.

The plurality of individual electrodes 19 provide electrical connection between each of the heat generating portions 9 and a driving IC 11. Moreover, under the condition where the plurality of heat generating portions 9 are bunched together in a plurality of groups, the individual electrodes 19 allow the heat generating portions 9 in each group to make electrical connection with a corresponding one of the driving ICs 11 provided for the groups, respectively.

A plurality of IC-connector connection electrodes 21 provide electrical connection between the driving IC and the connector 31. The plurality of IC-connector connection electrodes 21 connected to the corresponding driving ICs 11 are composed of a plurality of wiring lines having different functions.

The ground electrode 4 is placed so as to be surrounded by the individual electrode 19, the IC-connector connection electrode 21, and the main wiring portion 17*d* of the common electrode 17. The ground electrode 4 is maintained at a ground potential of 0 to 1 V.

The connection terminal 2 is led out on a side of the other long side 7*b* of the substrate 7 to connect each of the common electrode 17, the individual electrode 19, the IC-connector connection electrode 21, and the ground electrode 4 with the connector 31.

A plurality of IC-IC connection electrodes 26 provide electrical connection between adjacent driving ICs 11. The plurality of IC-IC connection electrodes 26 are each disposed so as to correspond with the IC-connector connection electrode 21, and transmit various signals to the adjacent driving ICs 11.

As shown in FIG. 1, the driving IC 11 is disposed so as to correspond with each of groups of the plurality of heat generating portions 9, and is connected to the other end of the individual electrode 19 and one end of the IC-connector connection electrode 21. Moreover, a plurality of driving ICs 11 are spaced apart from each other in the main scanning direction. The driving IC 11 has the function of controlling the current-carrying condition of each heat generating portion 9. As the driving IC 11, a switching member having a plurality of built-in switching elements is usable.

For example, the electrical resistance layer 15, the connection terminal 2, the common electrode 17, the individual electrode 19, the ground electrode 4, the IC-connector connection electrode 21, and the IC-IC connection electrode 26 as described above are formed by laminating layers of materials constituting the above components, respectively, on the thermal storage layer 13 one after another by a heretofore known thin-film forming technique such as sputtering, and working the resultant layered body into predetermined patterns by a heretofore known technique such as photoetching. Note that the connection terminal 2, the common electrode 17, the individual electrode 19, the ground electrode 4, the IC-connector connection electrode 21, and the IC-IC connection electrode 26 may be formed at one time through the same procedural steps.

As shown in FIGS. 1 and 2, on the thermal storage layer 13 formed on the upper surface of the substrate 7 is provided a protective layer 25 formed so as to cover the heat generating portion 9, part of the common electrode 17, and part of the individual electrodes 19.

The protective layer 25 is configured to protect the covered areas of the heat generating portion 9, the common electrode 17, and the individual electrode 19 against corrosion caused by adhesion of, for example, atmospheric water content, or against wear caused by contact with a recording medium which is subjected to printing. The protective layer 25 may be formed from SiN, $SiO_2$, SiON, SiC, diamond-like carbon, or the like, and, the protective layer 25 may have either a single layer form or a laminar stacked form. Such a protective layer 25 can be produced by a thin-film forming technique such as sputtering, or a thick-film forming technique such as screen printing.

Moreover, as shown in FIGS. 1 and 2, on the substrate 7 is provided a cover layer 27 which partly covers the common electrode 17, the individual electrode 19, and the IC-connector connection electrode 21. The cover layer 27 is intended to protect the covered areas of the common electrode 17, the individual electrode 19, the IC-IC connection electrode 26, and the IC-connector connection electrode 21 against oxidation caused by contact with air, or corrosion caused by adhesion of, for example, atmospheric water content.

The cover layer 27 is provided with an opening 27*a* to uncover the individual electrode 19, the IC-IC connection electrode 26, and the IC-connector connection electrode 21, and, the electrode wirings are connected to the driving IC 11 through the opening 27*a*. Moreover, the cover layer 27 has an opening 27*b* formed at its side located on a side of the other long side 7*b* of the substrate 7 to uncover the terminal electrode 2.

The driving IC 11 placed in the opening 27*a* of the cover layer 27 is sealed with a first cover member 29, while being electrically connected to the individual electrode 19, the IC-IC connection electrode 26, and the IC-connector connection electrode 21.

a plurality of first cover members 29 which are provided so as to correspond with the driving ICs 11 in the main scanning direction. Accordingly, when the recording medium P (refer to FIG. 5) is conveyed in contact with the top of the first cover member 29, the recording medium P makes a point contact with the first cover member 29 in the main scanning direction, thus permitting smooth conveyance of the recording medium P.

The first cover member 29 covers the driving IC 11 so that the driving IC 11 is not exposed, and further covers connection regions of the driving IC 11 and the wirings. The first cover member 29 has a vertex (not shown) which is located above the driving IC 11.

A height $W_{29}$ of the first cover member 29 from the substrate 7 (hereafter referred to as "the height $W_{29}$ of the first cover member 29") is, as exemplified, from 150 to 300 μm.

The first cover member 29 may be formed of a thermosetting resin such as epoxy resin or silicone resin. Moreover, the first cover member 29 may be formed of, for example, ultraviolet-curable resin or visible light-curable resin.

Figure 3:
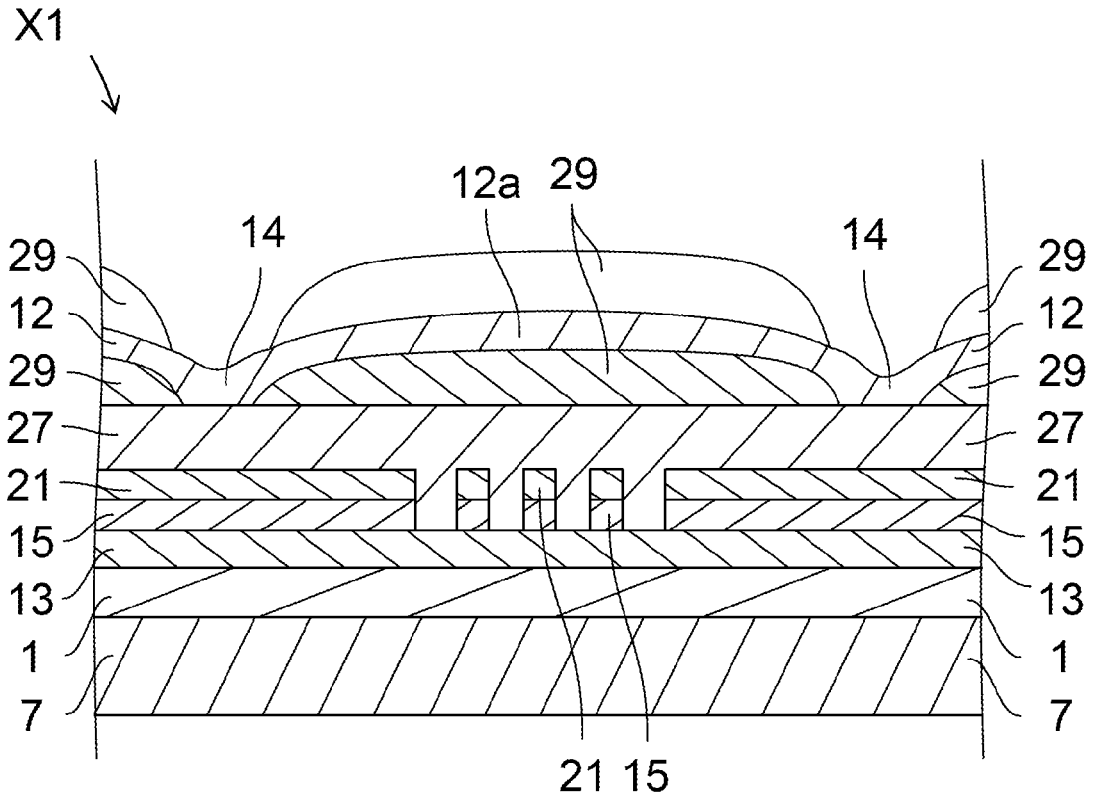
FIG. 3 is a sectional view of the thermal head taken along the line II-II shown in FIG. 1.

Referring to FIGS. 2 and 3, the electrical connection between the connector 31 and the head base body 3, and the mechanical connection between them established via the second cover member 12 will be described.

As shown in FIG. 1, the connector pin 8 is placed on the connection terminal 2 of the ground electrode 4, as well as on the connection terminal 2 of the IC-connector connection electrode 21. The connector 31 has a connecting section 31*a*, and, as shown in FIG. 2, the connection terminal 2 and the connector pin 8 are electrically connected to each other via a conductive member 23.

Exemplary of the conductive member 23 are solder and an anisotropic conductive adhesive obtained by blending conductive particles in an electrically insulating resin. This embodiment will be described with respect to the use of solder. The connector pin 8 can be electrically connected to the connection terminal 2 when covered with the conductive member 23. Note that a Ni-, Au-, or Pd-plating layer (not shown) may be interposed between the conductive member 23 and the connection terminal 2.

In the connector 31, the housing 10 is spaced at a predetermined distance from the side face 7*e* of the substrate 7. The second cover member 12 is placed between the side face 7*e* and the housing 10. It is possible to dispose the connector 31 without leaving a distance from the side face 7*e* of the substrate 7.

The second cover member 12 configured to protect connection regions is disposed so as to cover the connection terminal 2, the conductive member 23, and the connector pin 8 exposed from the housing 10. In this embodiment, the second cover member 12 extends over all of the connection terminal 2, the conductive member 23, and the connector pin 8 exposed from the housing 10 so as to seal the connection terminal 2, the conductive member 23, and the connector pin 8 exposed from the housing 10. Part of the second cover member 12 is placed on the first cover member 29 lying on the housing 10. Moreover, the second cover member 12 extends toward the first cover member 29 so as to seal the IC-connector connection electrode 21 exposed from the second opening 27*b*.

Like the first cover member 29, the second cover member 12 may be formed of a thermosetting resin such as epoxy resin or silicone resin. Moreover, the second cover member 12 may be formed of, for example, ultraviolet-curable resin or visible light-curable resin.

The second cover member 12 comprises a first portion 12*a* and a second portion 12*b*. The first portion 12*a* is disposed next to the connector 31, and has a vertex 12*a*1. The second portion 12*b* lies farther away from the connector 31 than the first portion 12*a*, and comprises an overlying part 12*b*1 and a recessed part 12*b*2. The overlying part 12*b*1 is a part of the second portion 12*b* located on the first cover member 29. The recessed part 12*b*2 is located between the overlying part 12*b*1 and the first portion 12*a*.

The first portion 12*a* is formed so as to cover the conductive member 23 and the connector pin 8. A height $W_{12a1}$ of the vertex 12*a*1 from the substrate 7 (hereafter referred to as "the height $W_{12a1}$ of the vertex 12*a*1") is, as exemplified, from 400 to 800 μm.

The second portion 12*b* is partly disposed on the first cover member 29, and is made thinner than the first portion 12*a*. A height $W_{12b1}$ of the overlying part 12*b*1 from the substrate 7 (hereafter referred to as "the height $W_{12b1}$ of the overlying part 12*b*1") is, as exemplified, from 100 to 300 μm.

The recessed part 12*b*2 is located between the overlying part 12*b*1 and the first portion 12*a*. A height $W_{12b2}$ of the recessed part 12*b*2 from the substrate 7 (hereafter referred to as "the height $W_{12b2}$ of the recessed part 12*b*2") is smaller than the height $W_{12b1}$ of the overlying part 12*b*1 from the substrate 7 and the height $W_{12a1}$ of the vertex 12*a*1. The height $W_{12b2}$ of the recessed part 12*b*2 from the substrate 7 is, as exemplified, from 40 to 290 μm.

The first portion 12*a* is disposed next to the connector 31. Moreover, the second portion 12*b* lies farther away from the connector 31 than the first portion 12*a*, and includes the overlying part 12*b*1 which overlies the first cover member 29. In this case, even if external force is exerted on the connector 31, the possibility of separation of the connector 31 from the substrate 7 can be reduced.

That is, when the first portion 12*a* is disposed next to the connector 31, the first portion 12*a* is capable of reducing the external force exerted in a direction from the connector 31 toward the driving IC 11. Moreover, since the first portion 12*a* and the second portion 12*b* are formed integrally with each other, and the second portion 12*b* includes the overlying part 12*b*1 which overlies the first cover member 29, it is possible to develop reaction in the opposite direction to the external force exerted in the direction from the connector 31 toward the driving IC 11, and thereby reduce the possibility of separation of the connector 31 from the substrate 7.

It is preferable that the thickness of the second portion 12*b* is equal to 30 to 80% of the thickness of the first portion 12*a*. In this case, while the first portion 12*a* absorbs the external force, the second portion 12*b* develops reaction against the external force.

Moreover, it is preferable that the thickness of the recessed part 12*b*2 is equal to 10 to 80% of the thickness of the second portion 12*b*. This makes it possible to increase the reaction developed by the overlying part 12*b*1.

The thickness of the first portion 12*a* refers to a heightwise distance from each member disposed on the substrate 7 so as to lie below the first portion 12*a* to the vertex of the first portion 12*a*. The thickness of the second portion 12*b* refers to a heightwise distance from each member disposed on the substrate 7 so as to lie below the second portion 12*b* to the vertex of the second portion 12*b*.

Moreover, the height $W_{12a1}$ of the vertex 12*a*1 is greater than the height $W_{29}$ of the first cover member 29. In this case, since a fair amount of the first portion 12*a* can be placed around the connector 31, it is possible to distribute the external force, and thereby reduce the possibility of separation of the connector 31 from the substrate 7.

Moreover, the recording medium P is brought into contact with the vertex 12*a*1, and is thus less prone to contact with the connector 31. This makes it possible to reduce the possibility of occurrence of a break in the recording medium P caused by contact with the connector 31.

Moreover, the recessed part 12*b*2 is located between the overlying part 12*b*1 and the vertex 12*a*1, and, the height $W_{12b2}$ of the recessed part 12*b*2 is smaller than the height $W_{12b1}$ of the overlying part 12*b*1 and the height $W_{12a1}$ of the vertex 12*a*1. In this case, the recessed part 12*b*2 is located below a line connecting the overlying part 12*b*1 and the vertex 12*a*1, wherefore the external force developed in the connector 31 creates a rotation moment about the recessed part 12*b*2. The overlying part 12*b*1, being higher in level than the recessed part 12*b*2, is capable of reducing the rotation moment resulting from the external force. That is, the overlying part 12*b*1 is capable of creating a rotation moment in the opposite direction to the rotation moment resulting from the external force by reaction. This makes it possible to reduce the possibility of separation of the connector 31 from the substrate 7.

The vertex 12*a*1*b* is a part of the second cover member 12 located farthest away from the substrate 7, and, the level of the second cover member 12 is indicative of the height $W_{12a1}$ of the vertex 12*a*1. The overlying part 12*b*1 defines a part located above the first cover member 29, and, the height of the overlying part 12*b*1 from the substrate 7 is indicative of the level of a part of the overlying part 12*b*1 located farthest away from the substrate 7. The height $W_{12b2}$ of the recessed part 12*b*2 is indicative of the level of a part of the second portion 12*b* located closest to the substrate 7.

Figure 4:
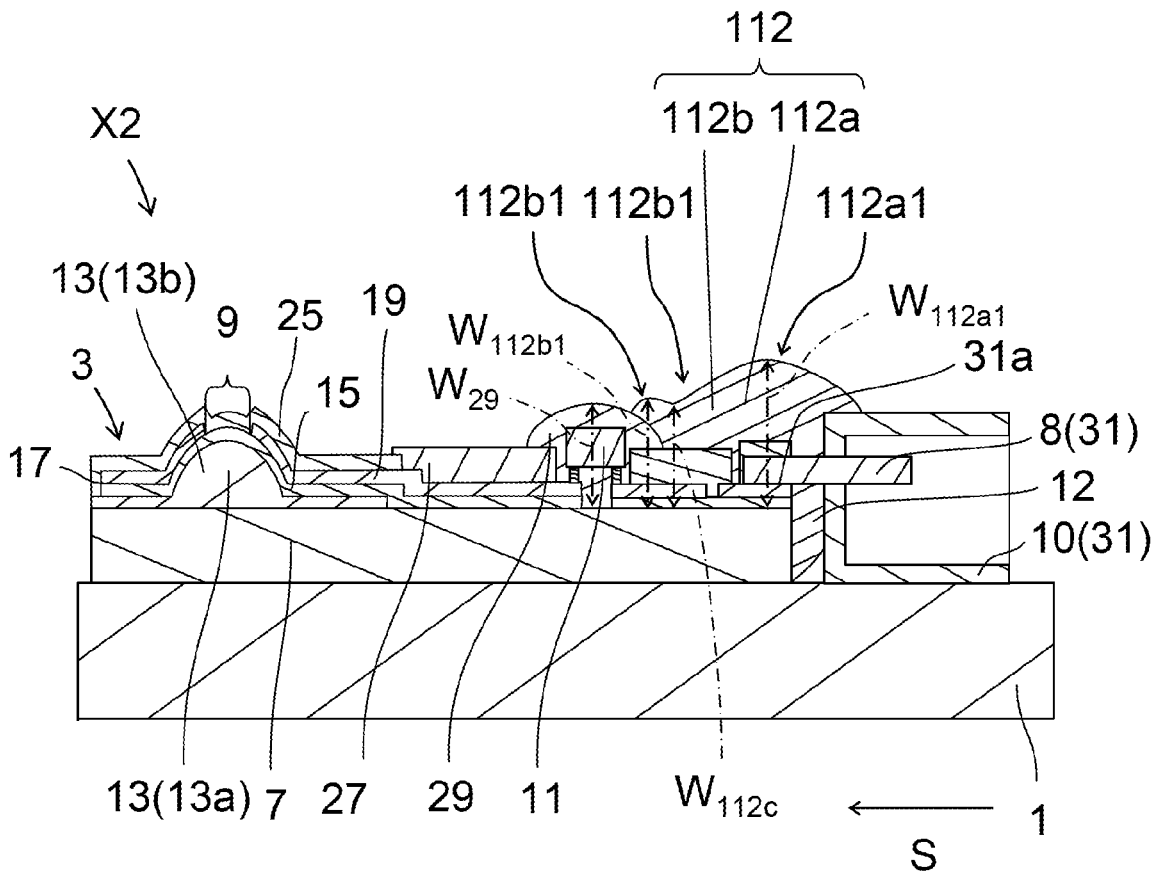
FIG. 4 is a sectional view corresponding to a section taken along the line I-I shown in FIG. 1, illustrating a modified example of the thermal head in accordance with the first embodiment of the invention.

The height $W_{12a1}$ of the vertex 12*a*1, the height $W_{12b1}$ of the overlying part 12*b*1, and the height $W_{12b2}$ of the recessed part 12*b*2 may be measured by, for example, observing the section passing through the IC-connector connection electrode 21 as shown in FIG. 4. It is also advisable to measure the height of the head base body 3 over the IC-connector connection electrode 21 by a surface roughness meter.

As shown in FIG. 1, in the second cover member 12 as seen in a plan view, a projection 14 is disposed between the adjacent first cover members 29 so as to protrude toward one long side 7*a* of the substrate 7. In this case, even if the external force is exerted on the connector 31 in the main scanning direction, since the projection 14 of the second cover member 12 serves as an anchor, it is possible to reduce the possibility of separation of the connector 31 from the substrate 7.

Moreover, it is preferable that the second cover member 12 has a Shore hardness of 80 to 100. The fulfillment of this condition makes it possible to reduce the possibility of separation of the connector 31 from the substrate 7. Shore hardness measurement may be effected by means of a durometer in general use or otherwise.

It is preferable that part of the first portion 12*a* is located on the housing 10. This makes it possible to reduce the possibility of separation of the connector 31 caused by the external force exerted on the first portion 12*a* in the direction of thickness of the substrate 7. Note that the first portion 12*a* does not necessarily have to be disposed on the housing 10.

For example, the thermal head X1 may be produced by the following method. To begin with, various electrodes are formed on the substrate 7, and, the protective layer 25 and the cover layer 27 are also formed. Then, the driving IC 11 is mounted in the opening 27*a* of the cover layer 27, and, the first cover member 29 is applied thereon with a dispenser or by printing technique, followed by curing treatment.

Next, the connector 31 is placed in the opening 27*b* of the cover layer 27, and, the connector 31 and the connection terminal 2 are soldered to each other. Then, the second cover member 12, whose viscosity has been adjusted to fall in the range of 10 to 30 Pa·s (at 20° C.), is applied so as to cover the connector pin 8. At this time, the application is carried out so that the height $W_{12a1}$ of the vertex 12*a*1 is greater than the height $W_{29}$ of the first cover member 29, and the second cover member 12 covers part of the first cover member 29. Lastly, the second cover member 12 is cured. In this way, the thermal head X1 is produced. In the case of providing the projection 14, by adjusting the viscosity to fall in the range of 50 to 70 Pa·s (at 20° C.), it is possible to place the projection 14 between the adjacent first cover members 29.

Although the second cover member 12 is, as exemplified, composed of the first portion 12*a*, the second portion 12*b*, and the recessed part 12*b*2, the recessed part 12*b*2 does not necessarily have to be provided.

Modified Example of First Embodiment

The following describes a thermal head X2 which is a modified form of the thermal head X1 with reference to FIG. 4. The thermal head X2 includes a first portion 112*a* and a second portion 112*b*. The first portion 112*a* has a vertex 112*a*1, and the second portion 112*b*2 comprises an overlying part 112*b*1 and a recessed part 112*b*1. A height $W_{112b1}$ of the overlying part 112*b*1 is greater than the height $W_{29}$ of the first cover member 29.

Figure 5:
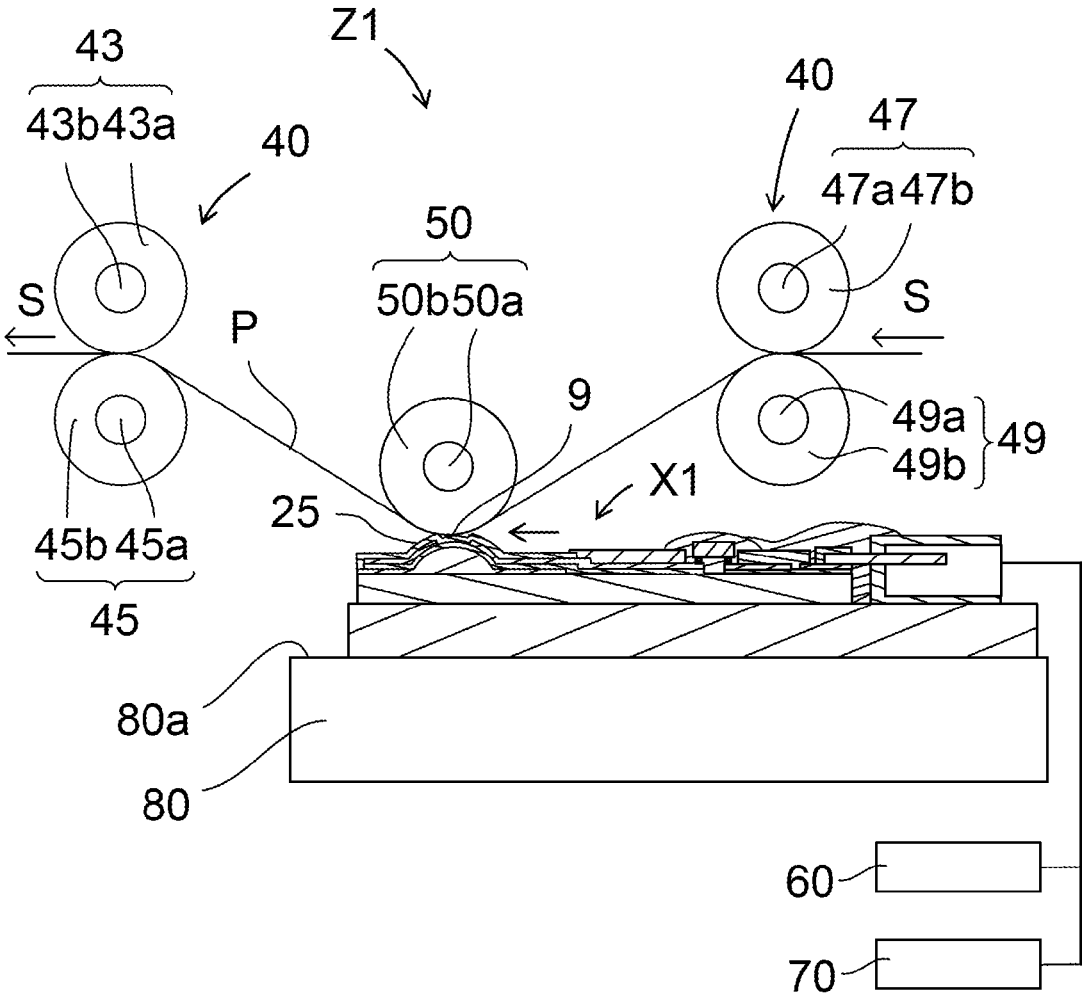
FIG. 5 is a view showing the general structure of a thermal printer in accordance with the first embodiment of the invention.

Accordingly, the vertex 112*a*1 having a height of $W_{112a1}$, the overlying part 112*b*1 having a height of $W_{112b1}$, and the first cover member 29 having a height of $W_{29}$ are disposed in decreasing order of height from an upstream side to a downstream side in a conveying direction S of the recording medium P (refer to FIG. 5). This makes it possible to convey the recording medium P smoothly to the heat generating portion 9, and thereby achieve high-definition printing.

Moreover, the height $W_{112b1}$ of the overlying part 112*b*1 is greater than the height $W_{29}$ of the first cover member 29. This makes it possible to develop reaction conducive to a reduction in the external force exerted on the connector 31, and thereby reduce the possibility of separation of the connector 31 from the substrate 7.

Next, a thermal printer Z1 will be described with reference to FIG. 5.

As shown in FIG. 5, the thermal printer Z1 according to the present embodiment comprises: the above-described thermal head X1; a conveyance mechanism 40; a platen roller 50; a power supply device 60; and a control unit 70. The thermal head X1 is attached to a mounting face 80*a* of a mounting member 80 disposed in a casing (not shown in the drawing) for the thermal printer Z1. The thermal head X1 is mounted in the mounting member 80 so that the direction of arrangement of the heat generating portions 9 conforms to the main scanning direction which is perpendicular to the recording-medium P conveying direction S which will hereafter be described.

The conveyance mechanism 40 comprises a driving section (not shown) and conveying rollers 43, 45, 47, and 49. The conveyance mechanism 40 is configured to carry the recording medium P, such for example as thermal paper or ink-transferable image receiving paper, in a direction indicated by arrow S shown in FIG. 5 so that the recording medium P can be conveyed onto the protective layer 25 located on the plurality of heat generating portions 9 of the thermal head X1. The driving section has the function of driving the conveying rollers 43, 45, 47, and 49, and, for example, a motor may be used as the driving section. For example, the conveying rollers 43, 45, 47, and 49 are constructed of cylindrical shaft bodies 43*a*, 45*a*, 47*a*, and

49*a* made of metal such as stainless steel covered with elastic members 43*b*, 45*b*, 47*b*, and 49*b* made of butadiene rubber or the like, respectively. Although not shown in the drawing, when using ink-transferable image receiving paper or the like as the recording medium P, in addition to the recording medium P, an ink film interposed between the recording medium P and the heat generating portion 9 of the thermal head X1 is also conveyed.

The platen roller 50 has the function of pressing the recording medium P from above against the protective layer 25 located on the heat generating portion 9 of the thermal head X1. The platen roller 50 is disposed so as to extend along a direction perpendicular to the conveying direction S of the recording medium P, and is fixedly supported at its ends so as to be rotatable while pressing the recording medium P from above against the heat generating portion 9. For example, the platen roller 50 may be constructed of a cylindrical shaft body 50*a* made of metal such as stainless steel covered with an elastic member 50*b* made of butadiene rubber or the like.

The power supply device 60 has the function of supplying electric current for enabling the heat generating portion 9 of the thermal head X1 to produce heat, as well as electric current for operating the driving IC 11. The control unit 70 has the function of feeding a control signal for controlling the operation of the driving IC 11 to the driving IC 11 in order to allow the heat generating portions 9 of the thermal head X1 to produce heat as described above in a selective manner.

In the thermal printer Z1, as shown in FIG. 5, the recording medium P is conveyed onto the heat generating portions 9 of the thermal head X1 by the conveyance mechanism 40 while being pressed from above against the heat generating portions 9 by the platen roller 50, and, the heat generating portions 9 are caused to produce heat in a selective manner by the power supply device 60 and the control unit 70, thus performing predetermined printing on the recording medium P. When using image receiving paper or the like as the recording medium P, printing is performed on the recording medium P by effecting thermal transfer of the ink of an ink film (not shown), which is being conveyed together with the recording medium P, onto the recording medium P.

Second Embodiment

A thermal head X3 will be described with reference to FIGS. 6 to 9. In this embodiment, the first electrode corresponds to the IC-connector connection electrode 21.

The thermal head X3 comprises: a heat dissipating plate 1; a head base body 3; an external substrate 6; and a flexible wiring board 5 (hereafter referred to as "FPC 5"). Moreover, a driving IC 11 is placed on the external substrate 6. The second embodiment will be described with respect to the case where the FPC 5 serves as a connection member for providing electrical connection between the construction and the exterior thereof. In this embodiment, and also in what follows, similar reference signs are used to denote like members. Note that, as the connection member, the connector 31 may be used as is the case with the first embodiment.

In the thermal head X3, the head base body 3 and the external substrate 6 are placed on the heat dissipating plate 1. The head base body 3 and the external substrate 6 are electrically connected to each other via a metal-made wire 16.

Figure 7:
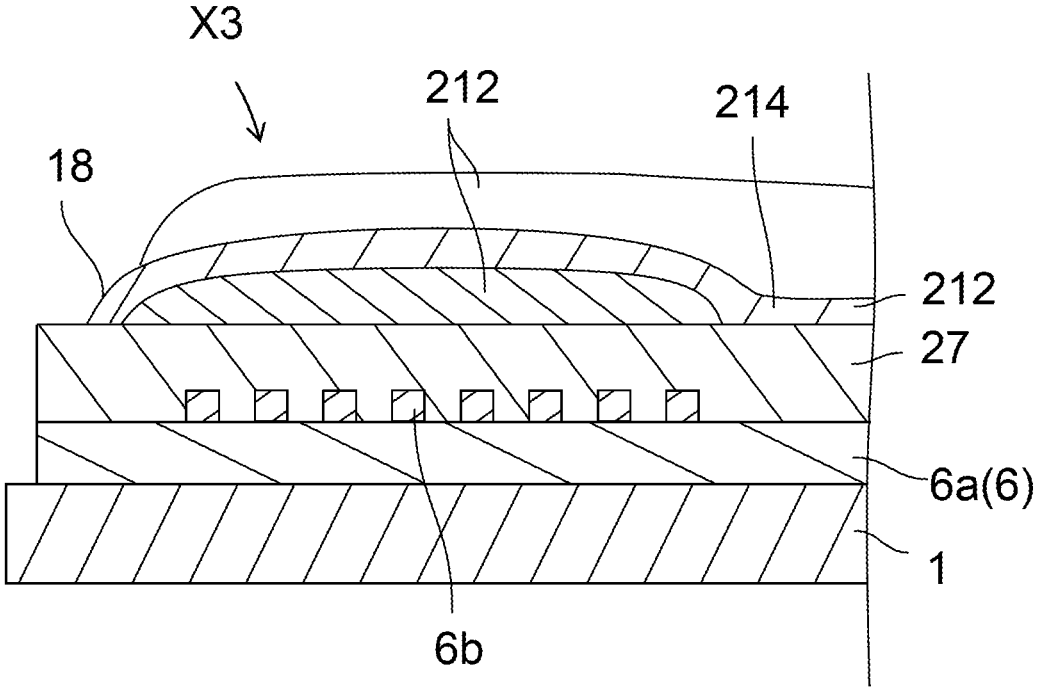
FIG. 7 is a sectional view of the thermal head taken along the line III-III shown in FIG. 6.
Figure 8:
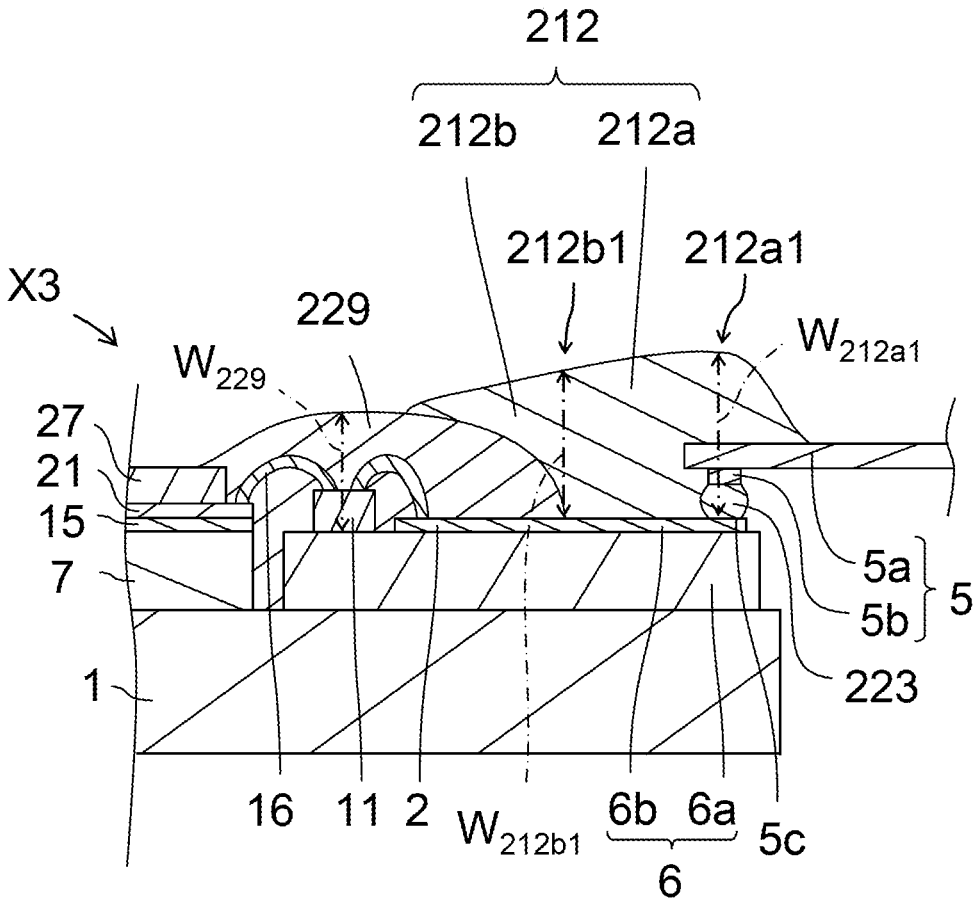
FIG. 8 is a sectional view of the thermal head taken along the line IV-IV shown in FIG. 6.

As shown in FIG. 7, the external substrate 6 comprises an insulating base body 6*a* and a wiring conductor 6*b* disposed on the base body 6*a*. As the external substrate 6, a substrate comprising the base body 6*a*, which is constructed of a flexible substrate such as a flexible printed wiring substrate, a glass epoxy substrate, or a polyimide substrate, with the pattern of the wiring conductor 6*b* defined thereon is usable. Moreover, the driving IC 11 is disposed on the external substrate 6 so as to be electrically connected to the wiring conductor 6*b* of the external substrate 6 via a wire 16.

Figure 6:
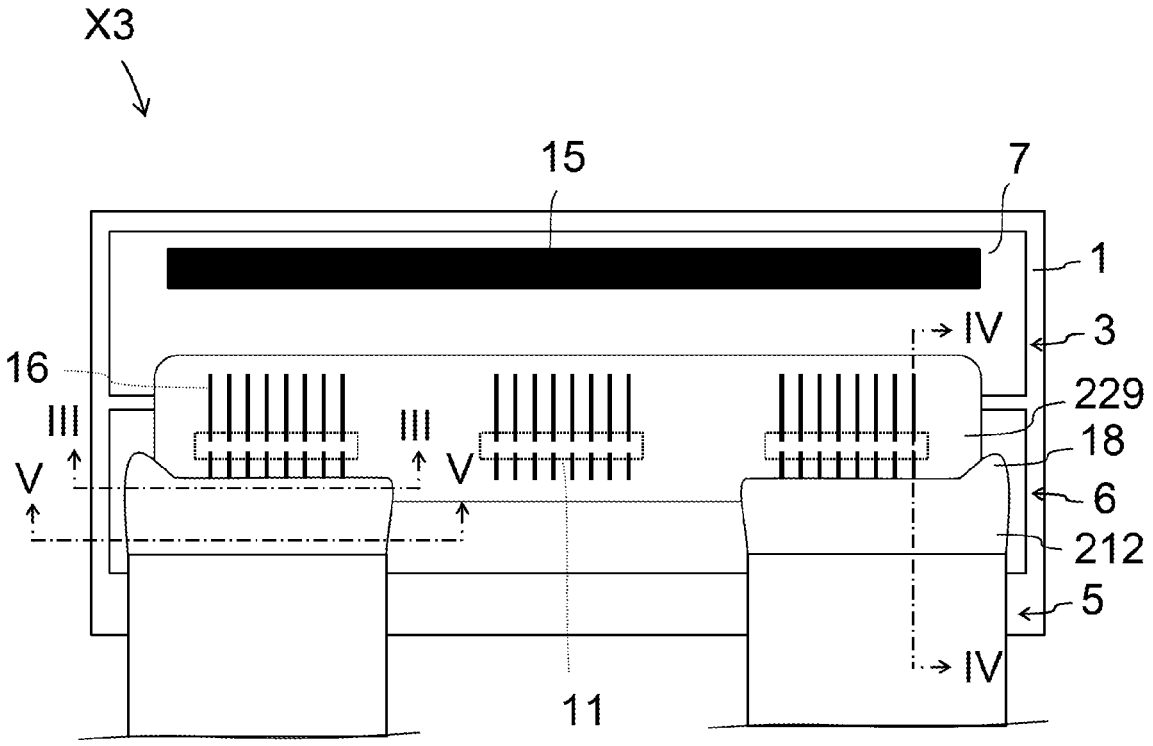
FIG. 6 is a plan view schematically showing the thermal head in accordance with a second embodiment of the invention.

As shown in FIG. 6, there is provided a first cover member 229 which is a continuous member elongated in the main scanning direction so as to lie over a plurality of driving ICs 11 disposed in the main scanning direction.

The wiring conductor 6*b* of the external substrate 6 is electrically connected to the exterior thereof via the FPC 5. The FPC 5 is formed by defining a pattern of a wiring 5*b* on a flexible base body 5*a*. The FPC 5 is disposed at each end of the external substrate in the main scanning direction. The wiring 5*b* of the FPC 5 is electrically connected to a connector (not shown) disposed on the opposite side to the external substrate 6.

Figure 9:
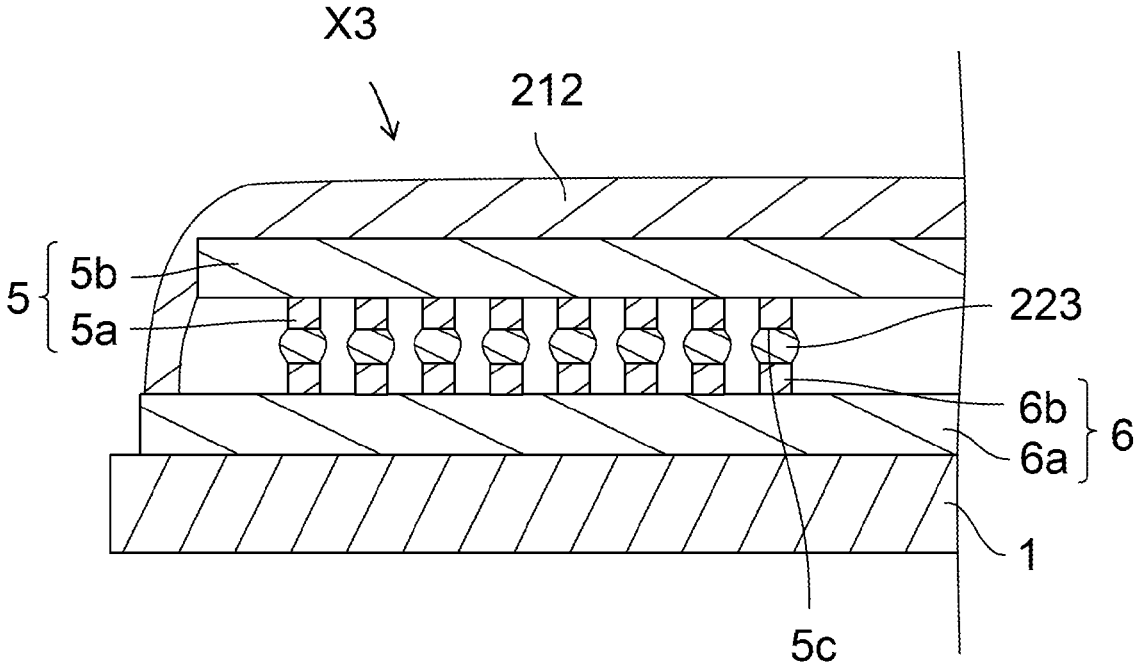
FIG. 9 is a sectional view of the thermal head taken along the line V-V shown in FIG. 6.

As shown in FIG. 9, the FPC 5 has a connecting section 5*c*, and, the external substrate 6 and the FPC 5 are electrically connected to each other via a conductive member 223. The conductive member 223 is made of a solder bump, and the external substrate 6 and the FPC 5 can be electrically connected to each other by heating the conductive member 223 in a state where the external substrate 6 and the FPC 5 are connected via the conductive member 223.

A second cover member 212 is disposed so as to extend from the FPC 5 to the first cover member 229. The first cover member 229-side edge of the second cover member 212 lies closer to the FPC 5 than the vertex (not shown) of the first cover member 229.

The second cover member 212 comprises a first portion 212*a*, a second portion 212*b*, and a projection 18. The first portion 212*a* has a vertex 212*a*1 located above the conductive member 223. The second portion 212*b* includes an overlying part 212*b*1 located on the first cover member 229. The projection 18 is disposed next to the first cover member 229 in the main scanning direction.

The first portion 212*a* is disposed next to the FPC 5, and, the second portion 212*b* lies farther away from the FPC 5 than the first portion 212*a*. The second portion 212*b* is thinner than the first portion 212*a*, and includes the overlying part 212*b*1 which overlies the first cover member 229.

When the first portion 212*a* is disposed next to the FPC 5, the first portion 212*a* is capable of reducing the external force exerted in a direction from the connector 31 toward the driving IC 11. Moreover, since the first portion 212*a* and the second portion 212*b* are formed integrally with each other, and the second portion 212*b* includes the overlying part 212*b*1 which overlies the first cover member 229, it is possible to develop reaction in the opposite direction to the external force exerted in the direction from the FPC 5 toward the driving IC 11, and thereby reduce the possibility of separation of the FPC 5 from the external substrate 6.

Moreover, a height $W_{212a1}$ of the vertex 212*a*1 from the external substrate 6 (hereafter referred to as "the height $W_{212a1}$") is greater than a height $W_{229}$ of the first cover member 229 from the external substrate 6 (hereafter referred to as "the height $W_{229}$"). In this case, even if the external force is exerted on the FPC 5 upward, by virtue of the placement of a fair amount of the second cover member 212, it is possible to reduce the possibility of separation of the FPC 5 from the external substrate 6. Moreover, the recording medium P is brought into contact with the vertex 212*a*1 of the second cover member 212, and is thus less prone to contact with the FPC 5. This makes it possible to reduce the possibility of occurrence of a break in the recording medium P caused by contact with the FPC 5.

Moreover, a height $W_{212b1}$ of the overlying part 212*b*1 from the external substrate 6 (hereafter referred to as "the height $W_{212b1}$") is greater than the height $W_{229}$ of the first cover member 229. Accordingly, the vertex 212*a*1 having the height $W_{212a1}$, the overlying part 212*b*1 having the height $W_{212b1}$, and the first cover member 229 having the height $W_{229}$ are disposed in decreasing order of height from the upstream side to the downstream side in the recording-medium P conveying direction S (refer to FIG. 5). This makes it possible to convey the recording medium P smoothly to the heat generating portion 9, and thereby achieve high-definition printing.

Moreover, in the second cover member 212 as seen in a plan view, the projection 18 is disposed in a region next to the first cover member 229 in the main scanning direction. Thus, the second cover member 212 is also located in a region next to the first cover member 229 in the main scanning direction. Therefore, even if the external force is exerted on the FPC 5 in the main scanning direction, since the projection 18 of the second cover member 212 is located on either side of the first cover member 229, it is possible to make the FPC 5 less prone to displacement under the external force, and thereby reduce the possibility of separation of the FPC 5 from the external substrate 6.

The thermal head X3 can be produced by placing the head base body 3 and the external substrate 6 on the heat dissipating plate 1, electrically connecting the FPC 5 onto the external substrate 6, and applying and curing the second cover member 212.

Modified Example 1 of Second Embodiment

Figure 10:
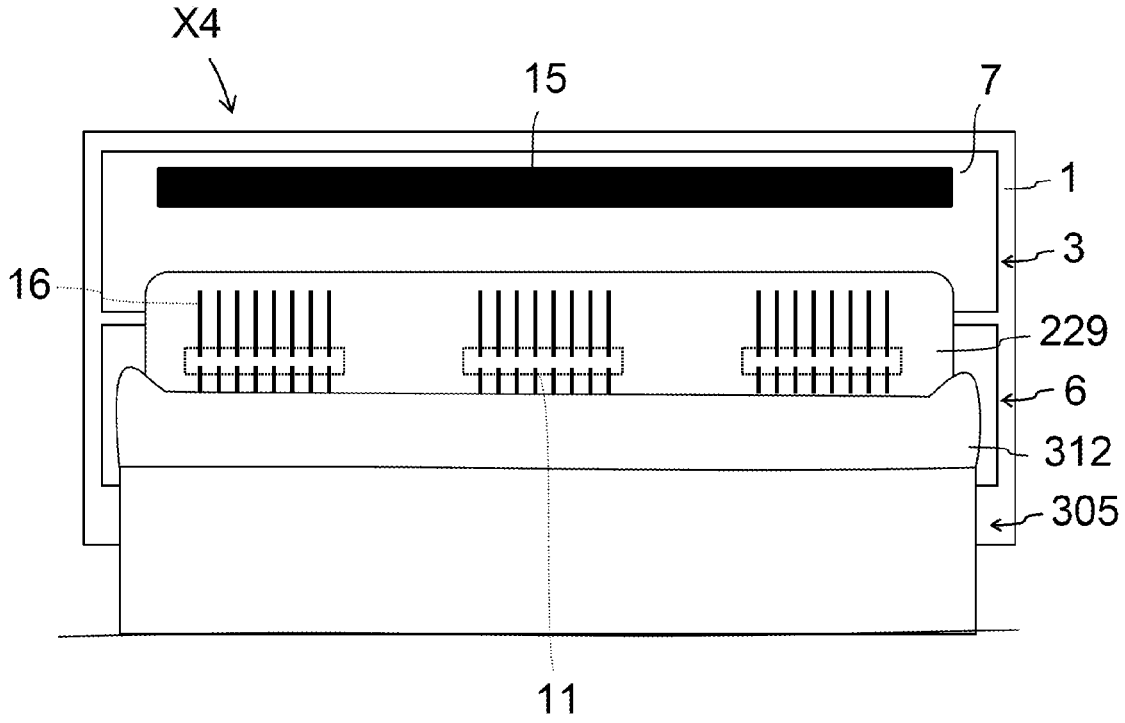
FIG. 10 is a plan view schematically showing a modified example of the thermal head in accordance with the second embodiment of the invention.

With reference to FIG. 10, the following describes a thermal head X4 according to a modified example of the thermal head X3. In the thermal head X4, an FPC 305 is disposed so as to extend in the main scanning direction, as well as to extend over substantially the entire area of the external substrate 6 in the main scanning direction. The FPC 305 and the external substrate are joined to each other at substantially the entire areas thereof in the main scanning direction via the conductive member 223 (refer to FIG. 8). A second cover member 312 is disposed over substantially the entire areas of the FPC 305 and the external substrate 6 in the main scanning direction.

The length of the FPC 305 in the main scanning direction is greater than the length of the first cover member 229 in the main scanning direction. In this case, when the second cover member 312 is applied so as to seal the conductive member 223, the second cover member 312 can be easily disposed in a region next to the first cover member 229 in the main scanning direction.

Modified Example 2 of Second Embodiment

Figure 11:
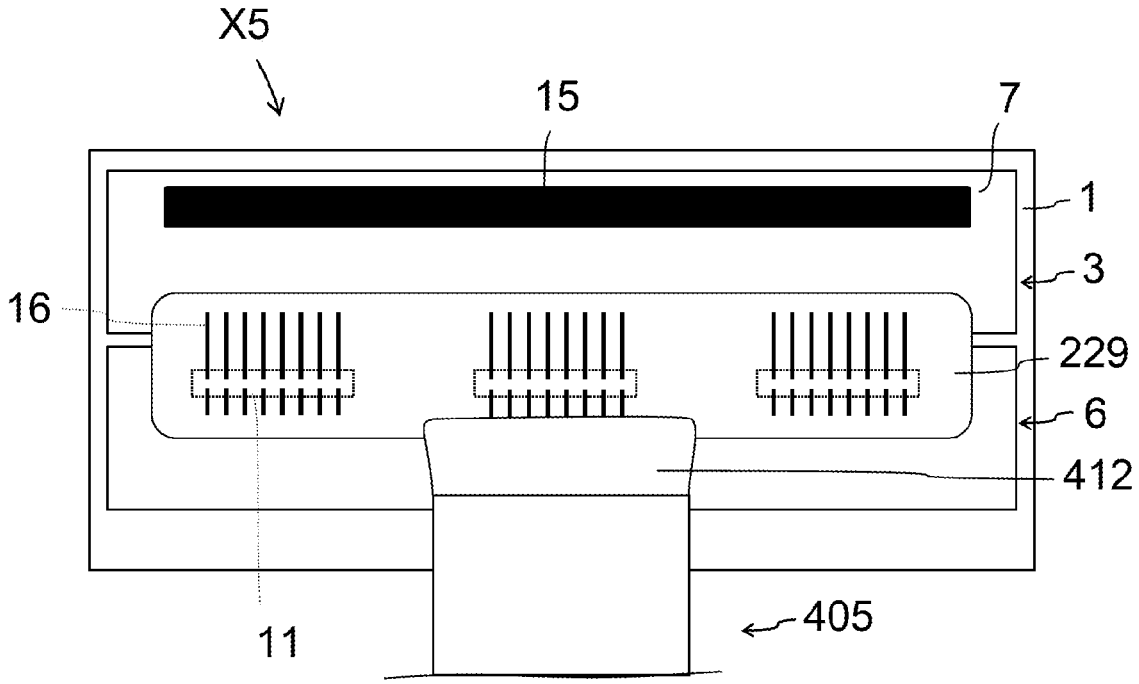
FIG. 11 is a plan view schematically showing another modified example of the thermal head in accordance with the second embodiment of the invention.

With reference to FIG. 11, the following describes a thermal head X5 according to a modified example of the thermal head X3. The thermal head X5 has an FPC 405 located at a center thereof in the main scanning direction. A second cover member 412 is placed on the FPC 405. In this construction, even if external force is exerted on the FPC 405, the second cover member 412 acts to repel the external force, thus reducing the possibility of separation of the FPC 405.

Moreover, in the thermal head X5, the second cover member 412 is so shaped that its length in the main scanning direction becomes larger gradually toward the driving IC 11. In this case, even if external force is exerted on the FPC 405 horizontally, a part of the second cover member 412 which is longer in the main scanning direction mitigates the external force exerted on the FPC 405, thus reducing the possibility of separation of the FPC 405 from the external substrate 6.

Third Embodiment

Figure 12:
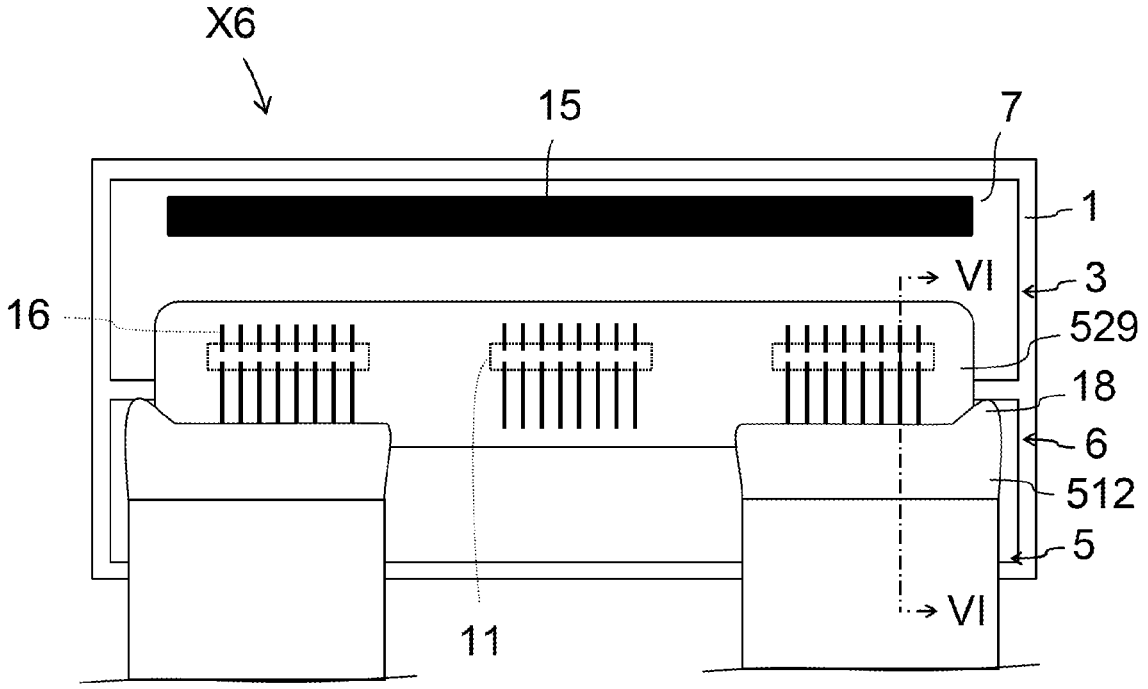
FIG. 12 is a plan view showing the thermal head in accordance with a third embodiment of the invention.
Figure 13:
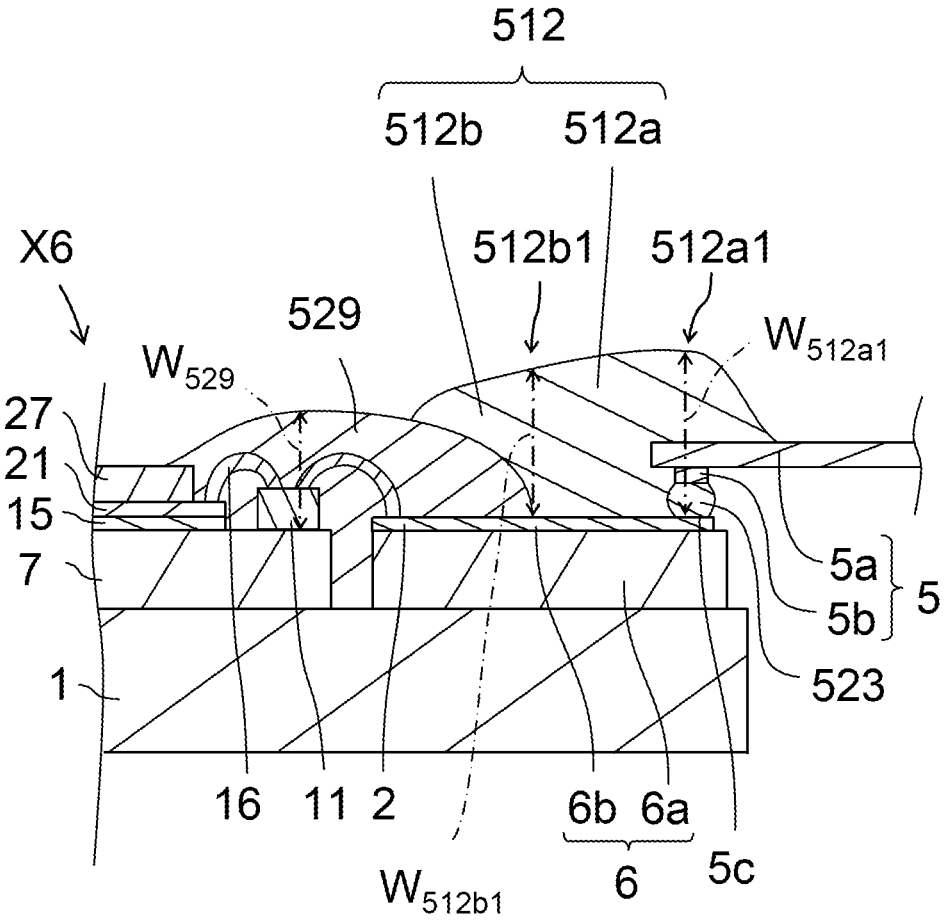
FIG. 13 is a sectional view of the thermal head taken along the line VI-VI shown in FIG. 12.

A thermal head X6 will be described with reference to FIGS. 12 and 13. The thermal head X6 differs from the thermal head X5 in that the driving IC 11 is placed on the substrate 7, and is otherwise identical with the thermal head X5.

In the thermal head X6, the driving IC 11 is placed on the substrate 7, and, a first cover member 529 is located on the substrate 7, as well as on the external substrate 6. More specifically, the first cover member 529 is disposed so as to extend from the driving IC 11 to the external substrate 6, and, in addition, lies between the substrate 7 and the external substrate 6.

A second cover member 512 is disposed on a FPC 5, and includes a first portion 512*a* and a second portion 512*b*. The first portion 512*a* is located above a conductive member 523, and has a vertex 512*a*1. The second portion 512*b* is partly located above the first cover member 529, and includes an overlying part 512*b*1. The overlying part 512*b*1 is disposed on the external substrate 6 so as to lie closer to the FPC 5 than the driving IC 11.

Accordingly, the placement of the first portion 512*a* next to the FPC 5 makes it possible to reduce the external force exerted in the direction from the connector 31 toward the driving IC 11. Moreover, since the first portion 512*a* and the second portion 512*b* are formed integrally with each other, and the first portion 512*a* includes the overlying part 512*b*1 which overlies the first cover member 529, it is possible to develop reaction in the opposite direction to the external force exerted in the direction from the FPC 5 toward the driving IC 11, and thereby reduce the possibility of separation of the FPC 5 from the external substrate 6.

Moreover, in the thermal head X6, the overlying part 512*b*1 has its edge located closer to the FPC 5 than a wire 16. In this construction, the wire 16 helps restrain the edge of the overlying part 512*b*1 from protruding in the direction of thickness of the external substrate 6.

Moreover, a height $W_{512a1}$ of the vertex 512*a*1 from the external substrate 6 is greater than a height $W_{529}$ of the first cover member 529 from the substrate 7. In this case, even if the external force is exerted on the FPC 5 upward, by virtue of the placement of a fair amount of the second cover member 512, it is possible to reduce the possibility of separation of the FPC 5 from the external substrate 6.

The first cover member 529 may be disposed only on the substrate 7, and, the second cover member 712 may be disposed so as to extend from the external substrate 6 to the substrate 7. In this case, the overlying part 512*b*1 is located on the substrate 7.

Fourth Embodiment

Figure 14:
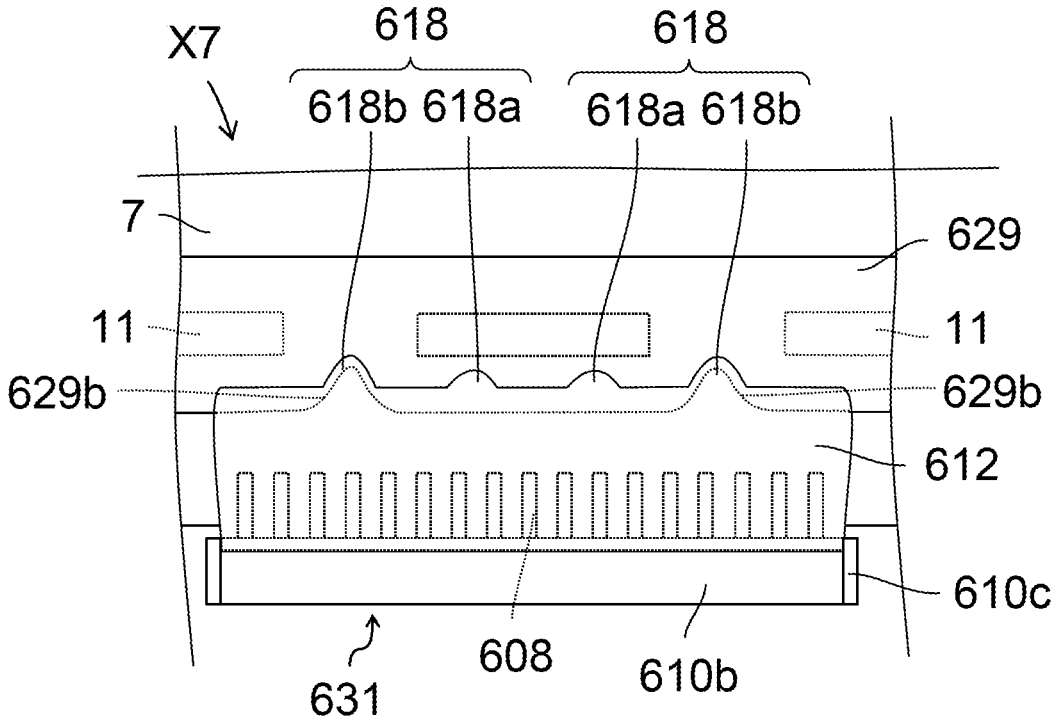
FIG. 14 is a plan view showing part of the thermal head in accordance with a fourth embodiment of the invention in enlarged dimension.

A thermal head X7 will be described with reference to FIGS. 14 and 15.

The thermal head X6 is provided with a first cover member 629 which is a continuous member elongated in the main scanning direction so as to correspond with a plurality of driving ICs 11 disposed in the main scanning direction. Moreover, the edge of the first cover member 629 located below a second cover member 612 is provided with a plurality of concavities 629*b* as seen in a plan view. Moreover, the first cover member 629-side edge of the second cover member 612 is provided with a plurality of convexities 618 protruding toward the driving IC 11 as seen in a plan view. The convexities 618 include a convexity 618*a* which is not received in the concavity 629*b* and a convexity 618*b* which is received in the concavity 629*b*.

An edge of the first cover member 629 located close to a connector 631 is provided with the plurality of concavities 629*b*. The concavity 629*b* is formed in a part of the first cover member 629 located between adjacent driving ICs 11.

Since the second cover member 612 is located above the connector 631-side edge of the first cover member 629, it follows that the concavities 629*b* are located below the second cover member 612. In this case, the area of contact between the second cover member 612 and the first cover member 629 can be increased, thus enhancing the adherability of the second cover member 612. This makes it possible to reduce the possibility of separation of the second cover member 612 from the first cover member 629.

An edge of the second cover member 612 located close to the driving IC 11 is provided with the plurality of convexities 618. Accordingly, even if external force is exerted on the connector 631, since the convexity 618 serves as an anchor against the external force, it is possible to mitigate the external force exerted on the connector 631, and thereby reduce the possibility of separation of the connector 631 from the substrate 7.

Moreover, the convexity 618*b* is received in the concavity 629*b* of the first cover member 629. Accordingly, the convexity 618*b* is securely held by the first cover member 629 in the main scanning direction. In consequence, even if external force is exerted on the connector 631 horizontally, since the convexity 618*b* is less prone to horizontal displacement and thus provides resistance to the external force exerted on the connector 631, it is possible to reduce the possibility of separation of the connector 631 from the substrate 7.

Moreover, in the main scanning direction, the protruding length of the convexity 618*b* received in the concavity 629*b* is greater than the protruding length of the convexity 618*a* received in other part than the concavity 629*b*. This makes it possible to reduce the possibility of separation of the connector 631 from the substrate 7.

Figure 15:
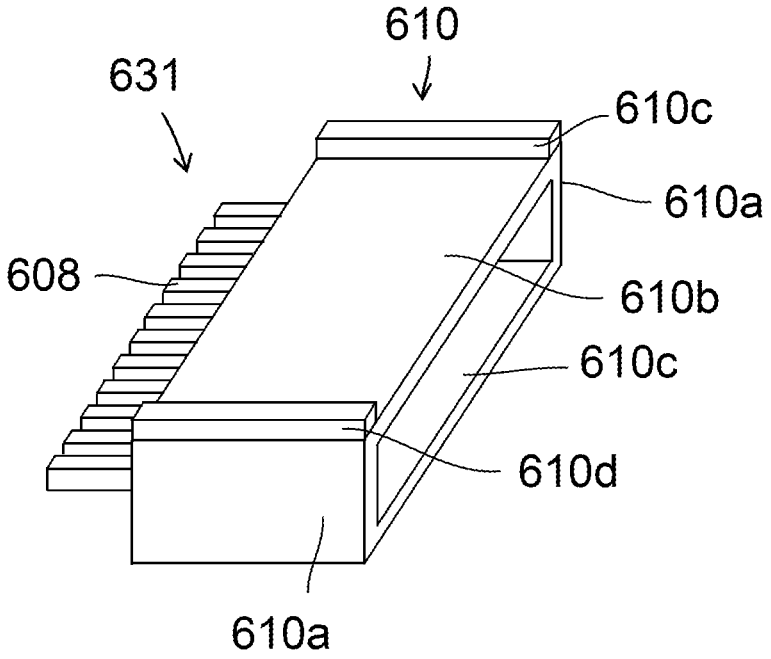
FIG. 15 is a perspective view of a connector constituting the thermal head in accordance with the fourth embodiment of the invention.

As shown in FIG. 15, the connector 631 comprises a box-shaped housing 610 and a connector pin 608 protruding from the housing 610. The housing 610 includes side walls 610*a*, an upper wall 610*b*, and a lower wall 610*c*. Moreover, the side walls 610*a* each have a first protrusion 610*d* extending upward from the upper wall 610*b*.

By virtue of the first protrusions 610*d* provided in the side walls 610 of the housing 610, the second cover member 612 located above the housing 610 is restrained from flowing toward the lateral side of the housing 610. This makes it possible to retain the second cover member 612 located above the housing 610, and thereby prevent separation of the connector 631.

Moreover, the first protrusions 610*d* restrain the flow of the second cover member 612 toward the lateral side of the housing 610, wherefore the second cover member 612 can be shaped so that its length in the main scanning direction becomes larger gradually toward the driving IC 11. This makes it possible to achieve further reduction of the possibility of separation of the connector 631 from the substrate 7.

Fifth Embodiment

Figure 16:
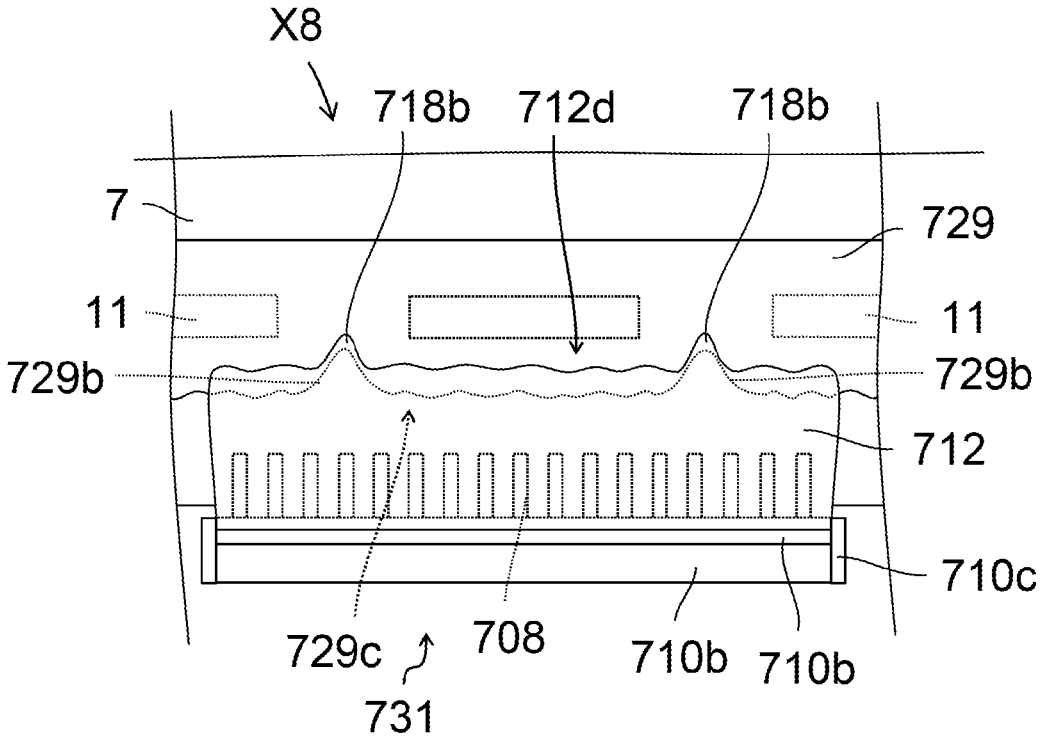
FIG. 16 is an enlarged plan view showing part of the thermal head in accordance with a fifth embodiment of the invention.
Figure 17:
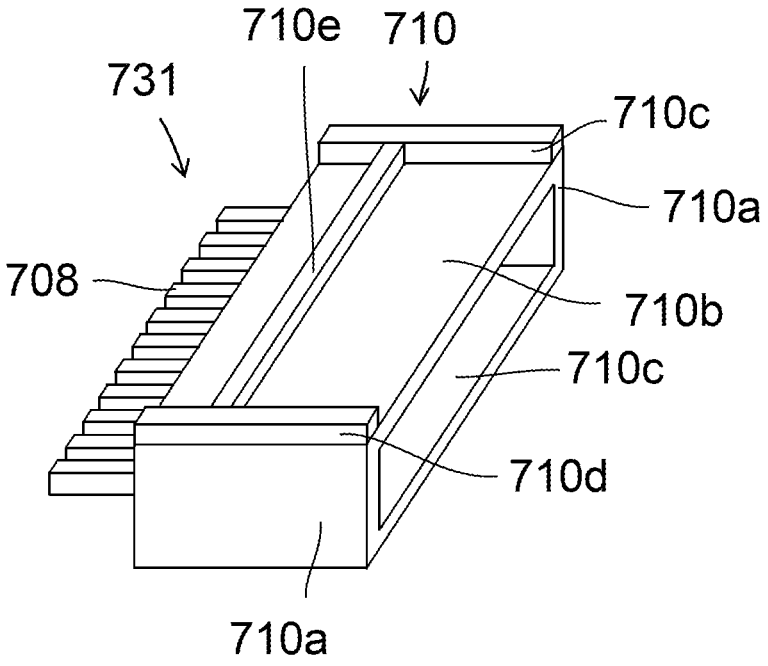
FIG. 17 is a perspective view of a connector constituting the thermal head in accordance with the fifth embodiment of the invention.

A thermal head X8 will be described with reference to FIGS. 16 and 17.

In the thermal head X7, an edge of a first cover member 729 is provided with, in addition to a concavity 729*b*, an undulation 729*c*. The undulation 729*c* is formed at the edge of the first cover member 729. Accordingly, the area of contact between the first cover member 729 and a second cover member 712 can be increased, thus enhancing the adherability of the second cover member 712. This makes it possible to achieve further reduction of the possibility of separation of a connector 731 from the substrate 7.

Moreover, the edge of the second cover member 712 has, in addition to a convexity 718*b*, an undulation 712*d*. The undulation 712*d* is located in a region extending in a sub-scanning direction from the region where the driving IC 11 is placed. This makes it possible to enhance the adherability of the second cover member 712 in the region extending in the sub-scanning direction from the driving IC 11-bearing region, which is greater than other region in height from the substrate 7. Accordingly, even if the recording medium P (refer to FIG. 5) and the second cover member 712 make contact with each other, it is possible to reduce the possibility of separation of the second cover member 712 from the first cover member 729.

A housing 710 includes side walls 710*a*, an upper wall 710*b*, a lower wall 710*c*, and a second protrusion 710*e*. The second protrusion 710 protrudes from the upper wall 610 while extending along the main scanning direction. As shown in FIG. 16, the second cover member 712 lies closer to the driving IC 11 than the second protrusion 710*e*.

Accordingly, the second protrusion 710*e* serves to check the flow of the second cover member 712, thus achieving firmer retention of the second cover member 712 located above the housing 710. This makes it possible to achieve further reduction of the possibility of separation of the connector 731 from the substrate 7.

Sixth Embodiment

Figure 18:
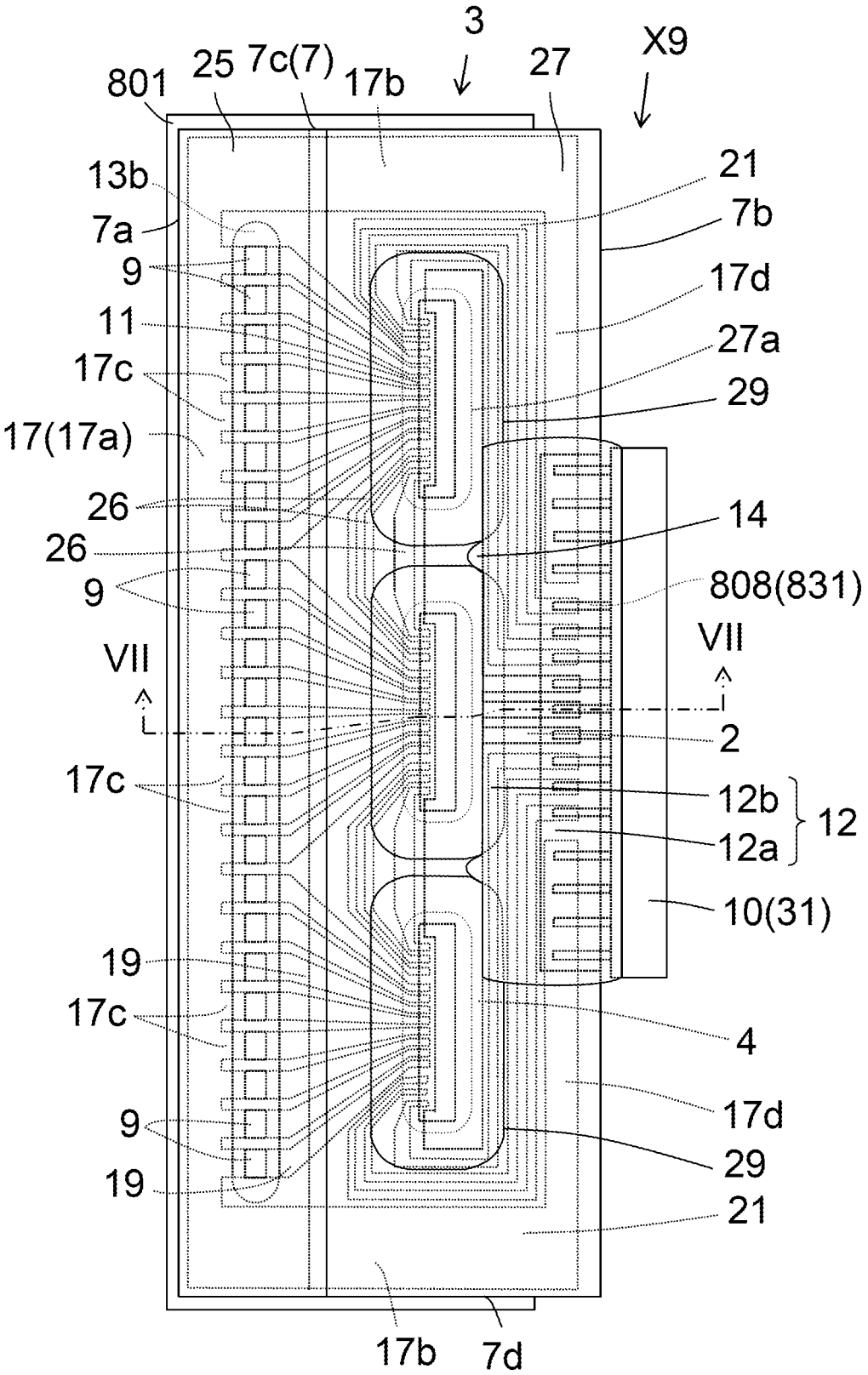
FIG. 18 is a plan view of a thermal head in accordance with a sixth embodiment of the invention.
Figure 19:
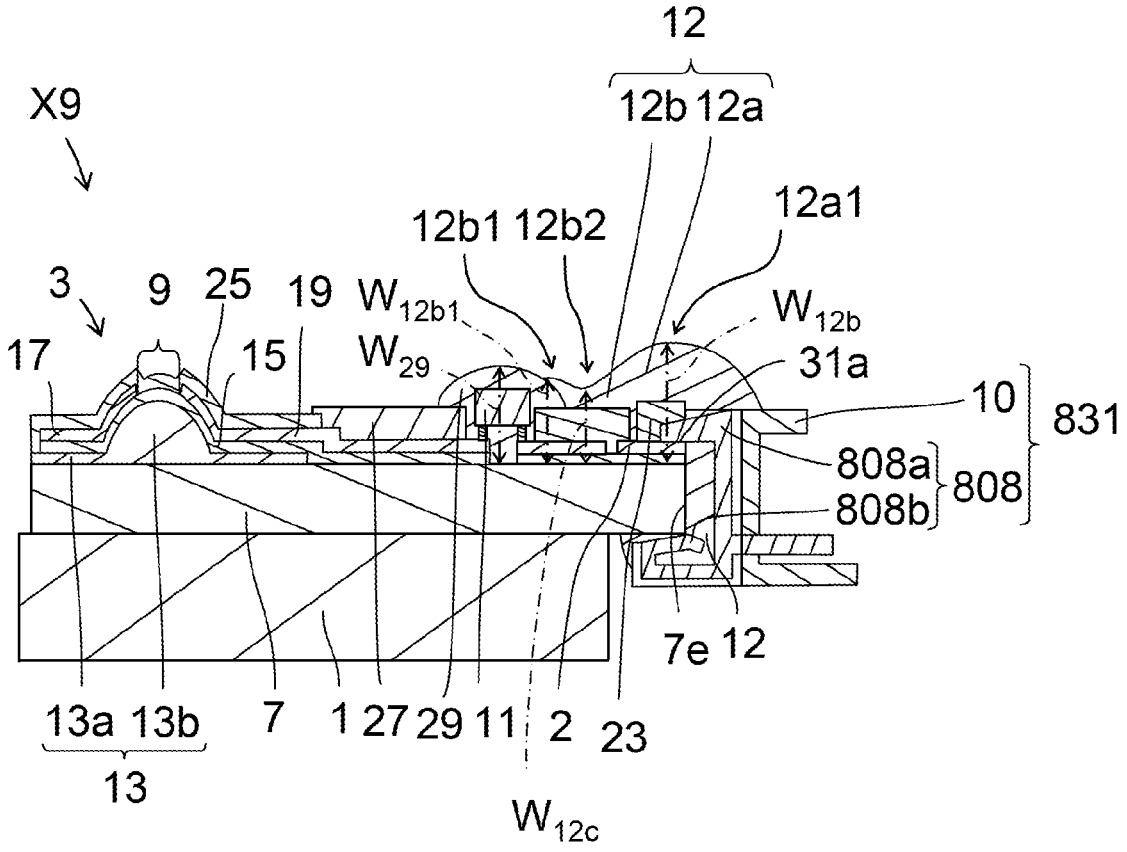
FIG. 19 is a sectional view of the thermal head taken along the line VII-VII shown in FIG. 18.

A thermal head X9 will be described with reference to FIGS. 18 and 19. The thermal head X9 differs from the thermal head X1 in the configurations of the heat dissipating plate and the connector, that is; has a heat dissipating plate 801 and a connector 831, and is otherwise identical with the thermal head X1.

In the thermal head X9, the substrate 7 is disposed on the heat dissipating plate 801. The substrate 7 is placed on the heat dissipating plate 801 so that one long side 7*a* is located on the heat dissipating plate 801, and the other long side 7*b* falls outside the heat dissipating plate 801.

The connector 831 comprises a housing 10 and a connector pin 808. The connector pin 808 includes a first connector pin 808*a* and a second connector pin 808*b*. The first connector pin 808*a* is located above the substrate 7, and is electrically connected to a terminal 2. The second connector pin 808*b* is located under the substrate 7. The connector 831 is designed so that the substrate 7 is held between the first connector pin 808*a* and the second connector pin 808*b*, and is thus formed integrally with the substrate 7.

In the thermal head X9, the connector 831 is connected to the other long side 7*b* of the substrate 7, and, the heat dissipating plate 801 is not provided under the connector 831. In this case, there is a possibility that external force is exerted on the connector 831 vertically at a time of attachment and detachment of the connector 831.

In this regard, in the thermal head X9, the first portion 12*a* is disposed next to the connector 831, and, the second portion 12*b* lies farther away from the connector 31 than the first portion 12*a*, and includes the overlying part 12*b*1 which overlies the first cover member 29.

In this construction, the first portion 12*a* allows distribution of external force through the second cover member 12. Moreover, the first portion 12*a* and the second portion 12*b* are formed integrally with each other, and the second portion 12*b* includes the overlying part 12*b*1. The overlying part 12*b*1 serves to develop reaction in the opposite direction to the external force exerted on the housing 10, thus reducing the possibility of separation of the connector 31 from the substrate 7.

While one embodiment of the invention has been described heretofore, it should be understood that the application of the invention is not limited to the embodiment thus far described, and that many modifications and variations of the invention are possible without departing from the scope of the invention. For example, although the thermal printer Z1 employing the thermal head X1 according to the first embodiment has been shown herein, this does not constitute any limitation, and thus the thermal heads X2 to X9 may be adopted for use in the thermal printer Z1. Moreover, the thermal heads X1 to X9 according to several embodiments may be used in combination.

Moreover, in the thermal head X1, the protuberant portion 13*b* is formed in the thermal storage layer 13, and the electrical resistance layer 15 is formed on the protuberant portion 13*b*. However, this does not constitute any limitation. For example, the heat generating portion 9 of the electrical resistance layer 15 may be placed on the underlayer portion 13*a* of the thermal storage layer 13 without forming the protuberant portion 13*b* in the thermal storage layer 13. Moreover, the thermal storage layer 13 may be formed over the entire area of the upper surface of the substrate 7.

Moreover, in the thermal head X1, the common electrode 17 and the individual electrode 19 are formed on the electrical resistance layer 15. However, this does not constitute any limitation as long as both of the common electrode 17 and the individual electrode 19 are connected to the heat generating portion 9 (electric resistor). For example, the common electrode 17 and the individual electrode 19 may be formed on the thermal storage layer 13, and the electrical resistance layer 15 may be formed only in a region between the common electrode 17 and the individual electrode 19 for the formation of the heat generating portion 9.

Furthermore, although the invention has been described with respect to the case where the thermal head is of a thin-film type in which the electrical resistance layer 15 is formed in thin-film form for the formation of a thin heat generating portion 9, this does not constitute any limitation. For example, the invention is applicable to a thermal head of a thick-film type in which the electrical resistance layer 15 is formed in thick-film form after patterning of each electrode for the formation of a thick heat generating portion 9. Moreover, the present technology is applicable to an edge-type head in which the heat generating portion 9 is formed at an end face of a substrate.

REFERENCE SIGNS LIST

X1-X9: Thermal head
Z1: Thermal printer
1: Heat dissipating plate
2: Connection terminal
3: Head base body
4: Ground electrode
5: Flexible printed wiring board (connection member)
5*a*: Base body
5*b*: Wiring
5*c*: Connecting section
6: External substrate
7: Substrate
8: Connector pin
9: Heat generating portion
10: Housing
11: Driving IC
12: Second cover member
12*a*: First portion
12*a*1: Vertex
12*b*: Second portion
12*b*1: Overlying part
12*b*2: Recessed part
13: Thermal storage layer
14: Projection
15: Electrical resistance layer
16: Wire
17: Common electrode
19: Individual electrode
21: IC-connector connection electrode
23: Conductive member
25: Protective layer
26: IC-IC connection electrode
27: Cover layer
29: First cover member
31: Connector (connection member)
31*a*: Connecting section

The invention claimed is:

1. A thermal head, comprising:
a substrate;
a heat generating portion disposed on the substrate;
a first electrode which is disposed on the substrate and is electrically connected to the heat generating portion;
a driving IC which is disposed on the substrate and controls actuation of the heat generating portion;
a first cover member which covers the driving IC;
a connection member which is disposed on the substrate and has a second electrode extending from the driving IC and a connecting section electrically connected to the second electrode; and
a second cover member which covers the connecting section and extends toward the first cover member,
the second cover member comprising a first portion and a second portion which is thinner than the first portion,
the first portion being disposed next to the connection member,
the second portion lying farther away from the connection member than the first portion, and including an overlying part which overlies the first cover member.

2. The thermal head according to claim 1,
wherein a height of the second cover member from the substrate is greater than a height of the first cover member from the substrate.

3. The thermal head according to claim 1,
wherein a height of the overlying part from the substrate is greater than a height of the first cover member from the substrate.

4. The thermal head according to claim 1,
wherein the second portion further includes a recessed part located between the overlying part and the first portion, and
a height of the recessed part from the substrate is smaller than a height of the first portion from the substrate and a height of the overlying part from the substrate.

5. A thermal head, comprising:
a substrate;
a heat generating portion disposed on the substrate;
an electrode which is disposed on the substrate and is electrically connected to the heat generating portion;
an external substrate which is disposed next to the substrate and comprises a wiring conductor connected to the electrode;
a driving IC which is disposed on the external substrate and controls actuation of the heat generating portion;
a first cover member which covers the driving IC;
a connection member having a connecting section electrically connected to the wiring conductor; and
a second cover member which covers the connecting section and extends toward the first cover member,
the second cover member comprising a first portion and a second portion which is thinner than the first portion,
the first portion being disposed next to the connection member,
the second portion lying farther away from the connection member than the first portion, and including an overlying part which overlies the first cover member.

6. The thermal head according to claim 5,
wherein a height of the second cover member from the external substrate is greater than a height of the first cover member from the external substrate.

7. The thermal head according to claim 5,
wherein a height of the overlying part from the external substrate is greater than a height of the first cover member from the external substrate.

8. The thermal head according to claim 5,
wherein the second portion further includes a recessed part located between the overlying part and the first portion, and
a height of the recessed part from the external substrate is smaller than a height of the first portion from the substrate and a height of the overlying part from the external substrate.

9. A thermal head, comprising:
a substrate;
a heat generating portion disposed on the substrate;
an electrode which is disposed on the substrate and is electrically connected to the heat generating portion;
an external substrate which is disposed next to the substrate and comprises a wiring conductor connected to the electrode;
a driving IC which is disposed on the substrate and controls actuation of the heat generating portion;
a first cover member which covers the driving IC;
a connection member having a connecting section electrically connected to the wiring conductor; and
a second cover member which covers the connecting section and extends toward the first cover member,
the second cover member comprising a first portion and a second portion which is thinner than the first portion,
the first portion being disposed next to the connection member,
the second portion lying farther away from the connection member than the first portion, and including an overlying part which overlies the first cover member.

10. The thermal head according to claim 9,
wherein a height of the second cover member from the external substrate is greater than a height of the first cover member from the substrate.

11. The thermal head according to claim 9,
wherein a height of the overlying part from the external substrate is greater than a height of the first cover member from the substrate.

12. The thermal head according to claim 9,
wherein the second portion further includes a recessed part located between the overlying part and the first portion, and
a height of the recessed part from the external substrate is smaller than a height of the first portion from the substrate and a height of the overlying part from the external substrate.

13. The thermal head according to claim 1,
wherein the thermal head further comprises a plurality of driving ICs which are spaced apart from each other in a main scanning direction, and a plurality of first cover members which are disposed so as to correspond with the driving ICs in the main scanning direction, and
the second cover member is also located between the first cover members adjacent to each other.

14. The thermal head according to claim 1,
wherein the thermal head further comprises a plurality of driving ICs which are spaced apart from each other in a main scanning direction, and the first cover member is provided as a continuous member elongated in the main scanning direction so as to correspond with the plurality of driving ICs,
the connection member is placed at each end of the substrate or the external substrate in the main scanning direction, and
the second cover member is also located in a region next to the first cover member in the main scanning direction.

15. The thermal head according to claim 1,
wherein a first cover member-side edge of the second cover member has an undulation as seen in a plan view.

16. The thermal head according to claim 1,
wherein an edge of the first cover member located below the second cover member has an undulation as seen in a plan view.

17. The thermal head according to claim 1,
wherein the connection member is a connector comprising a connector pin and a box-shaped housing which accommodates the connector pin, and
a side wall of the housing extending along a sub-scanning direction is provided with a first protrusion extending from an upper wall of the housing.

18. The thermal head according to claim 17,
wherein the housing has a second protrusion which protrudes from the upper wall of the housing and extends along the main scanning direction.

19. The thermal head according to claim 1,
wherein the second cover member has a Shore hardness of 80 to 100.

20. A thermal printer, comprising:
the thermal head according to claim 1;
a conveyance mechanism which conveys a recording medium onto the heat generating portion; and a platen roller which presses the recording medium from above against the heat generating portion.

* * * * *